US010584657B2

(12) United States Patent
Hunter

(10) Patent No.: US 10,584,657 B2
(45) Date of Patent: Mar. 10, 2020

(54) OIL COOLED INTERNAL COMBUSTION ENGINE CYLINDER LINER AND METHOD OF USE

(71) Applicant: AVL Powertrain Engineering, Inc., Plymouth, MI (US)

(72) Inventor: Gary Hunter, Dexter, MI (US)

(73) Assignee: AVL Powertrain Engineering, Inc., Plymouth, MI (US)

( * ) Notice: Subject to any disclaimer, the term of this patent is extended or adjusted under 35 U.S.C. 154(b) by 233 days.

(21) Appl. No.: 15/782,356

(22) Filed: Oct. 12, 2017

(65) Prior Publication Data

US 2018/0106210 A1 Apr. 19, 2018

Related U.S. Application Data

(60) Provisional application No. 62/408,251, filed on Oct. 14, 2016.

(51) Int. Cl.

| | |
|---|---|
| ***F02F 1/16*** | (2006.01) |
| ***F01P 3/02*** | (2006.01) |
| ***F02B 75/28*** | (2006.01) |

(52) U.S. Cl.

CPC ..... *F02F 1/16* (2013.01); *F01P 3/02* (2013.01); *F02B 75/28* (2013.01); *F02B 75/282* (2013.01); *F01P 2003/021* (2013.01)

(58) Field of Classification Search

CPC .... F02F 1/16; F02F 1/163; F02F 1/166; F02F 1/004; F02F 1/08; F02F 11/005; F01P 3/02; F01P 2003/021; F02B 75/28; F02B 75/282

See application file for complete search history.

(56) References Cited

U.S. PATENT DOCUMENTS

| | | | | |
|---|---|---|---|---|
| 5,176,113 A * | 1/1993 | Hama | ..... | F01P 3/02 123/41.79 |
| 5,207,188 A * | 5/1993 | Hama | ..... | F01P 3/02 123/41.74 |
| 7,000,584 B1 * | 2/2006 | Wynveen | ..... | F02F 1/16 123/193.2 |

* cited by examiner

*Primary Examiner* — Jacob M Amick

(57) ABSTRACT

An oil cooled cylinder liner, a method for cooling the same, and an opposed piston engine using the oil cooled cylinder liner are described. The cylinder liner includes a liner wall that has an inner face adjacent a piston bore and an outer face including an oil gallery surface. A plurality of grooves are disposed along the oil gallery surface. The grooves run parallel to each other and are spaced apart by bridging portions of the liner wall. At least some of the grooves have at least one fin disposed therein that runs parallel with the grooves. The grooves in combination with the fins increase surface area of the oil gallery to improve heat transfer from the liner wall to oil disposed along the oil gallery surface.

33 Claims, 9 Drawing Sheets

OIL COOLED INTERNAL COMBUSTION ENGINE CYLINDER LINER AND METHOD OF USE

CROSS-REFERENCE TO RELATED APPLICATIONS

This application claims the benefit of U.S. Provisional Application No. 62/408,251, filed on Oct. 14, 2016. The entire disclosure of the application referenced above is incorporated herein by reference.

FIELD

The present disclosure generally relates to the field of internal combustion engines. More specifically, a cylinder liner is disclosed for use in an internal combustion engine that is cooled by oil instead of water or a water and anti-freeze solution.

BACKGROUND

This section provides background information related to the present disclosure which is not necessarily prior art.

Many internal combustion engines utilize cylinder liners or sleeves. Such internal combustion engines generally include an engine block having one or more cylinders. A piston is disposed within each cylinder when the internal combustion engine is fully assembled. Cylinder liners, which are generally cylindrical in shape, are positioned within the cylinder of the internal combustion engine between the piston and the engine block. Accordingly, the piston does not directly contact the engine block. Although cylinder liners often add complexity to the engine block, cylinder liners have many advantages. The cylinder liner presents a wear surface that can be replaced in the event of excessive wear. Excessive wear may occur in internal combustion engines that experience piston or ring failure. In such instances, the internal combustion engine can be more easily repaired without the need for re-boring and honing the engine block or replacing the engine block altogether. Cylinder liners can also be made from a different material than the material used in the engine block. Accordingly, the engine block can be made of a lighter, more brittle material such as aluminum to save weight, while the cylinder liner can be made of a heavier, stronger material such as cast iron to improve thermodynamics and durability.

One design problem that arises in internal combustion engines that utilize cylinder liners is how to effectively draw heat away from the cylinder liners. Cylinder liners are exposed to combustion and therefore are subject to high thermal loads. The cylinder liners themselves are relatively thin and often conduct heat better than the adjacent material of the engine block, making thermal management of the cylinder liner difficult. One solution to this problem is commonly referred to as a "wet liner" arrangement. In this arrangement, at least part of the cylinder liner is placed in direct contact with coolant water or a water and anti-freeze solution. The coolant water or water and anti-freeze solution flows through a water jacket disposed between at least a portion of the cylinder liner and the engine block. Thermal management is achieved more readily because heat from the cylinder liner is transferred directly to the coolant water or water and anti-freeze solution. The coolant water or water and anti-freeze solution in the water jacket is replenished so that heat is continuously being drawn away from the cylinder liner. Water is used as a coolant because water has a very high specific heat capacity, a high density, and exhibits good thermal conductivity. As a result, high heat transfer coefficients can be achieved when water or a water and anti-freeze solution is used to cool the cylinder liners of internal combustion engines.

The use of water or a water and anti-freeze solution as an engine coolant does have some drawbacks however. Corrosion of metal components increases significantly when such components are exposed to water. As a result, water coolant can corrode elements of the engine coolant system and surfaces of the water jacket passages. Should a leak occur, corrosion of other engine components is also likely to occur. If the leak is inside the engine, other problems can develop. Water does not combine with gas or oil. Therefore, water inside the engine can displace the oil and create excessive wear because, unlike oil, water is not a lubricant. These problems are exaggerated in opposed-piston engines because of the sealing difficulties associated with the layout and packaging of opposed-piston engines.

Opposed-piston engines generally include two pistons housed within each cylinder that move in an opposed, reciprocal manner within the cylinder. In this regard, during one stage of operation the pistons are moving away from one another within the cylinder and during another stage of operation the pistons are moving towards one another within the cylinder. As the pistons move towards one another within the cylinder, they compress and, thus, cause ignition of a fuel/air mixture disposed within the cylinder. In so doing, the pistons are forced apart from one another, thereby exposing the inlet port and the exhaust port. Exposing the inlet port draws air into the cylinder and this in combination with exposing the exhaust port expels exhaust, thereby allowing the process to begin anew. When the pistons are forced apart from one another, connecting rods respectively associated with each piston transfer the linear motion of the pistons relative to and within the cylinder to two crankshafts disposed on opposite sides of the cylinder. The longitudinal forces imparted on the crankshafts by the connecting rods cause rotation of the crankshafts which, in turn, cause rotation of wheels of a vehicle in which the engine is installed.

Generally speaking, opposed-piston engines include a bank of cylinders with each cylinder having a pair of pistons slidably disposed therein. While the engine may include any number of cylinders, the particular number of cylinders included is generally dictated by the type and/or required output of the vehicle. For example, in an automobile, fewer cylinders may be required to properly propel and provide adequate power to the vehicle when compared to a heavier vehicle such as a commercial truck, a ship, or tank. Accordingly, a light vehicle may include an engine having three (3) cylinders and six (6) pistons while a heavier vehicle may include five (5) or six (6) cylinders and ten (10) or twelve (12) pistons, respectively.

Such opposed-piston engines typically have a one-piece engine block (i.e. made from a single casting). The opposed-piston engine includes two crankcases, one disposed to one side of the cylinders and the other disposed on an opposite side of the cylinders. The two crankshafts are supported in the two crankcases for rotation therein. A cylinder liner may be inserted into each of the cylinders from one crankcase or the other. In order to properly accommodate and seal the cylinder liner in the one piece engine block, complicated machining in the cylinder and/or the cylinder liner is required because access to these areas is limited, making it difficult to seal the inlet and exhaust ports in the cylinder liner. As such, the inlet and exhaust ports present an entry point through which water can leak out of the water jacket and into the combustion chamber.

SUMMARY

This section provides a general summary of the disclosure and is not a comprehensive disclosure of its full scope or all of its features.

The cooling of internal combustion engines using oil as a cooling media instead of water or a water and anti-freeze solution presents many opportunities and challenges. The largest advantage is the elimination of water or water and anti-freeze solutions from the internal combustion engine, which simplifies internal sealing requirements and eliminates the burden of maintaining an additional fluid for service and repair. Moreover, oil cooling can provide more uniform temperature profiles throughout the cooled portions of the internal combustion engine. The challenges presented by using oil as the cooling media lies in the differences between the thermal and physical properties of oil as compared to water or water and anti-freeze solutions. Oil suffers from a lower specific heat capacity, density, and thermal conductivity as compared to water or water and anti-freeze solutions. Oil also has high viscosity, making turbulence enhanced heat transfer more difficult to attain. Testing has shown that for the same cooling media velocities and cooling passage dimensions, the use of oil as a cooling media results in heat transfer coefficients that are approximately ten to fifteen times lower than those of water or a water and anti-freeze solution.

The subject disclosure provides for a cylinder liner that has been adapted for improved oil cooling. The design of the disclosed cylinder liner advantageously overcomes the inefficiencies traditionally associated with oil cooling. The cylinder liner disclosed herein includes a liner wall that extends annularly about a piston bore. The liner wall has an inner face adjacent the piston bore and an outer face that is oppositely arranged with respect to the inner face. The outer face of the liner wall includes an oil gallery surface that is co-extensive with at least part of the outer face. A plurality of grooves are disposed along the oil gallery surface that extend inwardly into the liner wall to increase a surface area of the oil gallery surface. The plurality of grooves run parallel to each other and each groove of the plurality of grooves has a groove depth and a groove width. The plurality of grooves are spaced apart by bridging portions of the liner wall. At least some of the grooves in the plurality of grooves have at least one fin disposed therein that runs parallel to the plurality of grooves. The bridging portions of the liner wall each have a bridging portion width and the fins each have a maximum fin width that is smaller than the bridging portion width.

In accordance with another aspect, the subject disclosure provides for an opposed-piston engine assembly that utilizes the cylinder liner described herein. The opposed-piston engine assembly has an engine block defining at least one cylinder bore that extends along a longitudinal axis. The opposed-piston engine includes the cylinder liner described herein, where the cylinder liner is received within the cylinder bore of the engine block. The liner wall of the cylinder liner defines the piston bore. The opposed-piston engine also includes first and second crankshafts disposed at opposite ends of the cylinder liner and a pair of pistons slidingly disposed in the piston bore of the cylinder liner. The pair of pistons are movable along the longitudinal axis toward one another in a first mode of operation and away from one another along the longitudinal axis in a second mode of operation. A combustion chamber is disposed within the piston bore of the cylinder liner between the pair of pistons. The plurality of grooves disposed along the oil gallery surface are parallel to each other and cooperatively define an oil gallery. A plurality of fins extend along the liner wall at locations disposed within at least some of the grooves in the plurality of grooves to increase the surface area of the oil gallery surface of the cylinder liner and improve heat transfer from the liner wall to oil disposed in the oil gallery. Again, the plurality of fins are parallel to the plurality of grooves.

In accordance with yet another aspect, the subject disclosure provides for a method of cooling the cylinder liner described herein when the cylinder liner is disposed in an engine block of an internal combustion engine. The method includes the steps of passing oil through the oil gallery disposed between the engine block and the cylinder liner and increasing heat transfer between the cylinder liner and the oil passing through the oil gallery by manufacturing the cylinder liner with an oil gallery surface that has the plurality of grooves and fins described herein.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION

Figure 1:
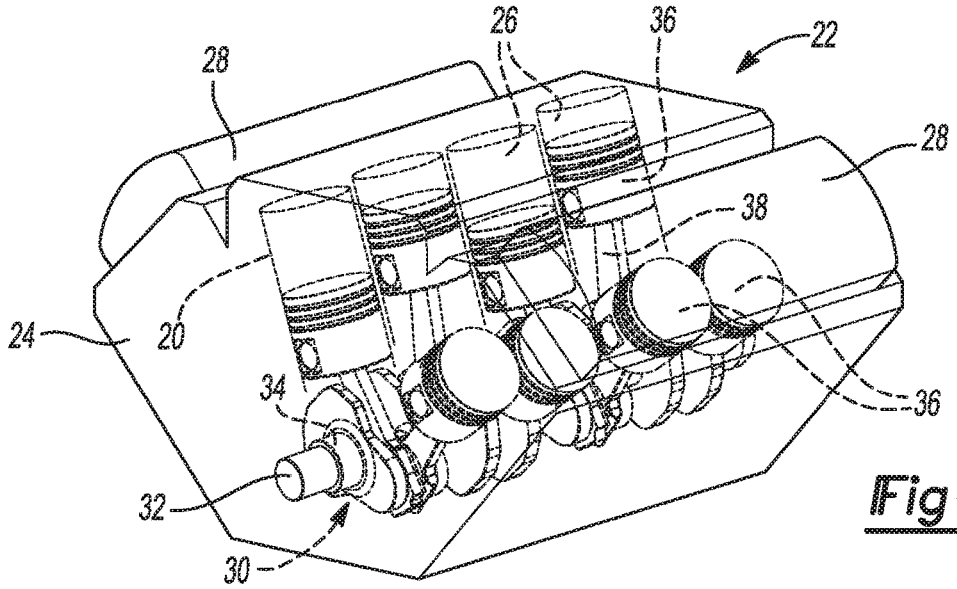
FIG. 1 is a front perspective view of an exemplary internal combustion engine.

Referring to the Figures, wherein like numerals indicate corresponding parts throughout the several views, a cylinder liner 20 is disclosed.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

It should initially be understood that the cylinder liner 20 disclosed herein exists as one of many component parts of an internal combustion engine 22. In general, the cylinder liner 20 may be utilized for each cylinder of the internal combustion engine 22. The internal combustion engine 22 could be, without limitation, a spark ignition engine (e.g. a gasoline fueled engine) or a compression ignition engine (e.g. a diesel fueled engine). One exemplary internal combustion engine 22 is illustrated in FIG. 1. With reference to FIG. 1, the internal combustion engine 22 generally includes an engine block 24 with one or more cylinder bores 26. Cylinder heads 28 mate with the engine block 24 and close off the cylinder bores 26 of the engine block 24. Opposite the cylinder heads 28, the cylinder bores 26 are open to a crankcase 30 defined by the engine block 24. The internal combustion engine 22 includes a crankshaft 32 that is disposed within the crankcase 30. The crankshaft 32 is carried on bearings 34 such that the crankshaft 32 may rotate freely within the crankcase 30. A piston 36 is situated in each cylinder bore 26 of the engine block 24. Combustion occurs in each of the cylinder bores 26 between the cylinder head 28 and the piston 36. A connecting rod 38 extends between and connects each piston 36 to the crankshaft 32. The combustion process drives each piston 36 in a reciprocating motion within each respective cylinder bore 26 and the connecting rods 38 translate the reciprocating motion of the pistons 36 into rotational motion of the crankshaft 32.

Figure 2:
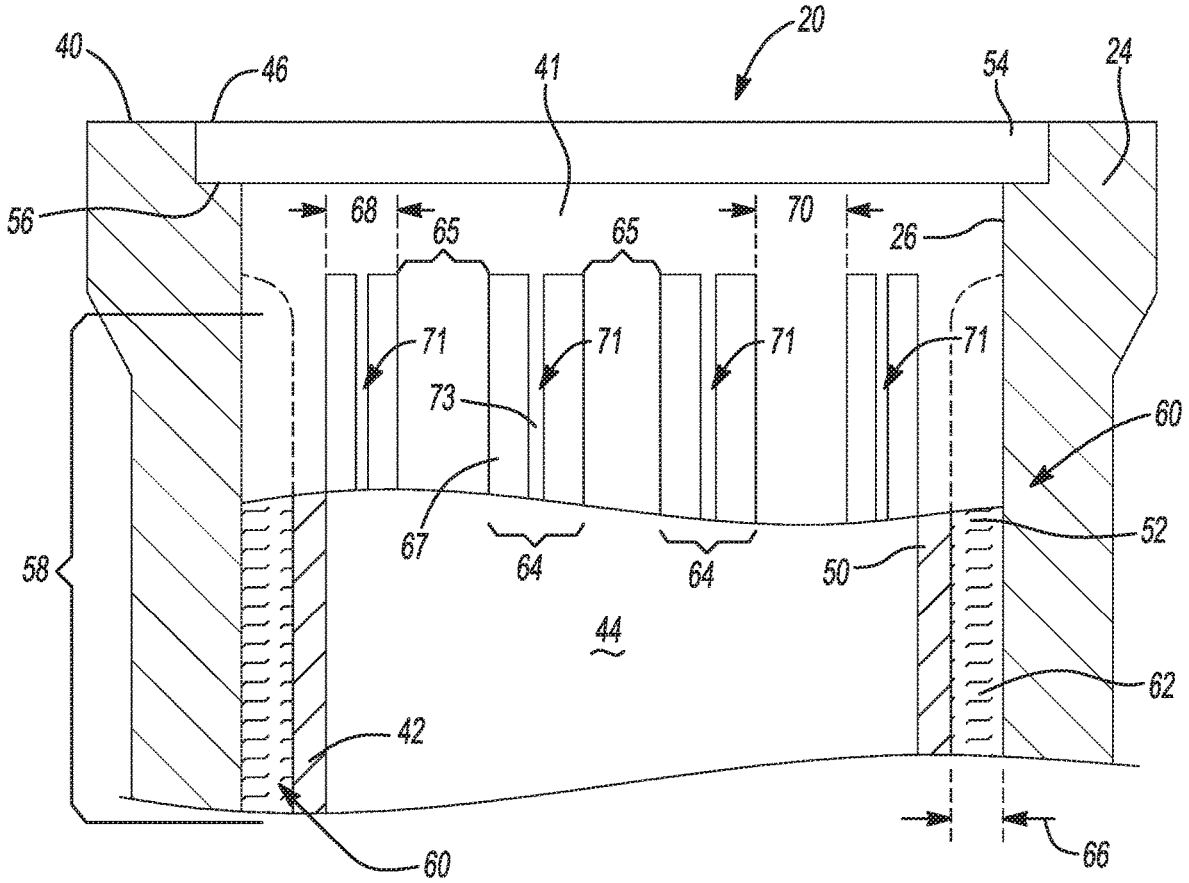
FIG. 2 is a partial cross-sectional view of an exemplary engine block with an exemplary cylinder liner that is constructed in accordance with the subject disclosure.

Referring to FIG. 2, a partial cross-sectional view of the engine block 24 is illustrated. From these views, it can be seen that the cylinder liner 20 is disposed in the cylinder bore 26 of the engine block 24 such that the cylinder liner 20 is positioned radially between the piston 36 and the engine block 24. Accordingly, the piston 36 contacts the cylinder liner 20 rather than the engine block 24 itself. The cylinder liner 20 is positioned axially within cylinder bore 26 so that it is flush with or below a deck surface 40 of the engine block 24. It should be appreciated that the cylinder heads 28 abut the deck surface 40 of the engine block 24 when the cylinder heads 28 are installed on the engine block 24. The cylinder liner 20 may be a stand-alone component that is separately made from the engine block 24 or the cylinder liner 20 may be integral with the engine block 24. Both configurations fall within the scope of the subject disclosure. Where the cylinder liner 20 is separately made, the cylinder liner 20 is inserted and/or pressed into the cylinder bore 26 of the engine block 24 during assembly of the internal combustion engine 22.

The cylinder liner 20 is made from a first material 41, which may or may not be the same material as the engine block 24. Advantageously, where the cylinder liner 20 is made from a different material than that used for the engine block 24, the cylinder liner 20 may be made to have improved strength, improved wear resistance, better thermal characteristics, and reduced friction. Internal combustion engines having cylinder liners may also be more easily serviced because a damaged cylinder liner can simply be replaced, thereby reducing or eliminating the need for labor intensive boring and honing of the engine block.

Figure 3:
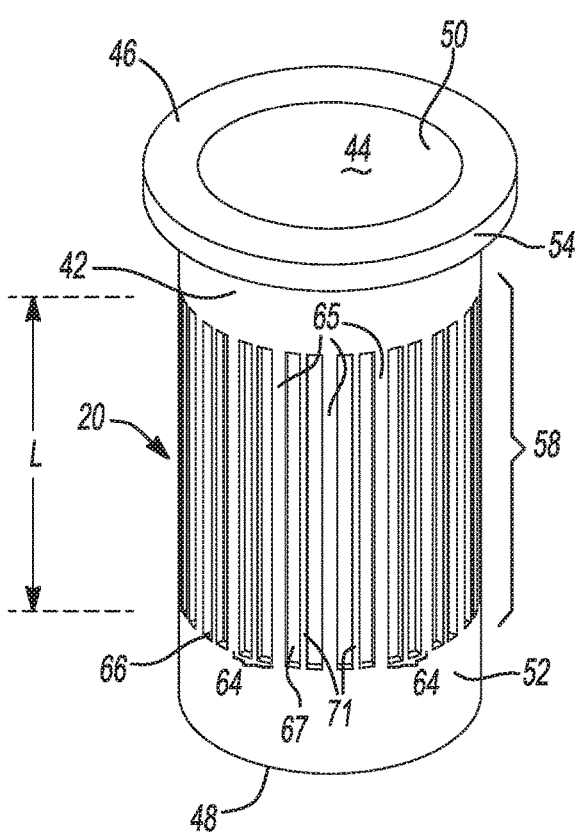
FIG. 3 is a front perspective view of an exemplary cylinder liner that is constructed in accordance with the subject disclosure.
Figure 3:
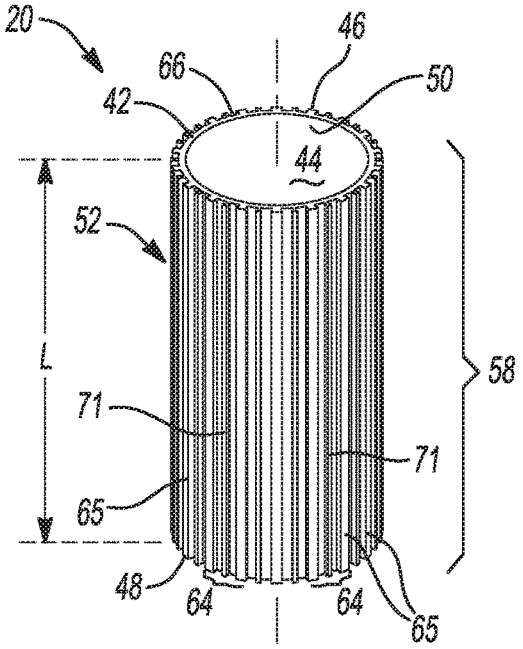
Figure 4:
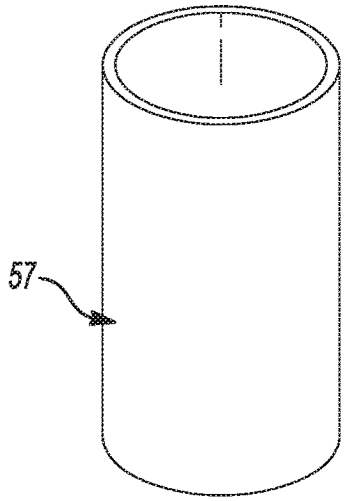
FIG. 4 is an exploded perspective view of an exemplary cylinder liner constructed in accordance with the subject disclosure before it is inserted into the exemplary engine block of FIG. 2.
Figure 4:
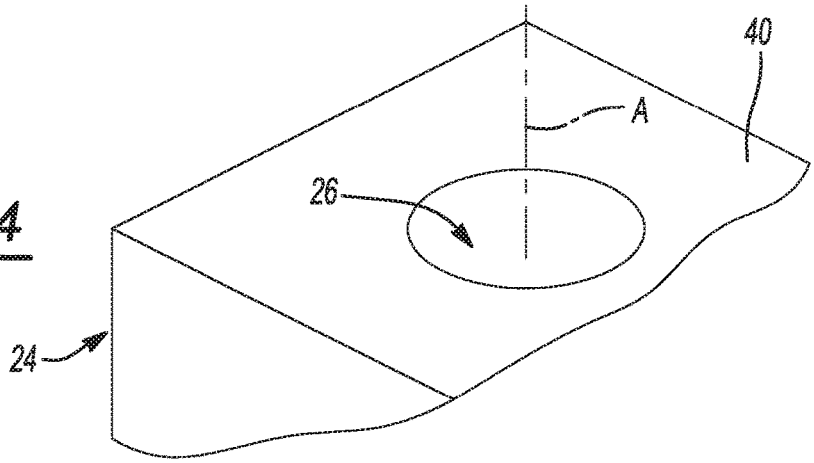

FIGS. 3 and 4 depict two exemplary variations of the disclosed cylinder liner 20, shown prior to insertion into the cylinder bore 26 of the engine block 24. Typically, cylinder liners 20 are manufactured separately from the engine block 24 and are subsequently installed in the engine block 24 before the pistons 36 are installed. Notwithstanding, this exemplary manufacturing and assembly process may be modified and is not intended to limit the subject disclosure.

Referring generally to FIGS. 1-4, the cylinder liner 20 includes a liner wall 42 that extends annularly about a piston bore 44 and axially between a first end 46 and a second end 48. The first end 46 of the liner wall 42 is disposed adjacent the deck surface 40 of the engine block 24 and the second end 48 of the liner wall 42 is disposed adjacent the crankcase 30 of the engine block 24. The liner wall 42 has an inner face 50 adjacent the piston bore 44 and an outer face 52 that faces the cylinder bore 26 of the engine block 24. Accordingly, the outer face 52 of the liner wall 42 is oppositely arranged with respect to the inner face 50 of the liner wall 42. The inner face 50 of the liner wall 42 presents a smooth cylindrical surface extending from the first end 46 of the liner wall 42 to the second end 48 of the liner wall 42. When the cylinder liner 20 is installed in a fully assembled internal combustion engine 22, the inner face 50 of the liner wall 42 contacts the piston 36. To minimize drag between the piston 36 and the cylinder liner 20 and/or improve thermal characteristics, the inner face 50 of the liner wall 42 may optionally receive a coating or treatment.

The liner wall 42 may or may not have a variable thickness. Several features may be disposed at various axial positions along the cylinder liner 20. As shown in FIGS. 2 and 3, a flange 54 may optionally be provided that projects radially outwardly from the first end 46 of the liner wall 42. The flange 54 may be configured to mate with a shoulder 56 formed in the cylinder bore 26 adjacent the deck surface 40. Thus, when the cylinder liner 20 is installed in the cylinder bore 26 the flange 54 abuts the shoulder 56 to axially locate the cylinder liner 20 with respect to the cylinder bore 26 and prevent over-insertion of the cylinder liner 20 beyond the flange 54. As shown in FIG. 4, the liner wall 42 may alternatively be free of the flange 54 and the cylinder bore 26 may or may not have the shoulder 56. Also, a sleeve 57 may optionally be provided between the cylinder liner 20 and the cylinder bore 26. When the sleeve 57 is included, the sleeve 57 may either be slid over the cylinder liner 20 before the cylinder liner 20 and the sleeve 57 are inserted into the cylinder bore 26 or the sleeve 57 may be first inserted into the cylinder bore 26 followed by insertion of the cylinder liner 20 into the sleeve 57. Although various configurations are possible, the sleeve 57 may be equal in length to the cylinder liner 20. Accordingly, the outer face 52 of the liner wall 42 either faces and/or directly abuts the cylinder bore 26 as shown in FIG. 2 or faces and/or directly abuts the sleeve 57 as shown in FIG. 4. The cylinder liner 20, the cylinder bore 26, and the optional sleeve 57 are all co-axially aligned with a longitudinal axis A.

Referring to FIGS. 2-4 generally, the outer face 52 of the liner wall 42 includes an oil gallery surface 58 that is co-extensive with at least part of the outer face 52. A plurality of grooves 64 are disposed along the oil gallery surface 58 which is located along the outer face 52 of the liner wall 42. The plurality of grooves 64 extend inwardly into the liner wall 42 toward the inner face 50 of the liner wall 42 where each groove 64 in the plurality of grooves 64 has a bottom 67. The oil gallery surface 58 extends between, into, and across the plurality of grooves 64 such that the plurality of grooves 64 increase a surface area of the oil gallery surface 58. The plurality of grooves 64 define an oil gallery 60 (one or more channels through which oil 62 is communicated). The oil gallery 60 operably receives oil 62 when the internal combustion engine 22 is placed into service. The oil 62 is pumped through the oil gallery 60 to cool the cylinder liner 20 and the engine block 24. Heat created by the combustion process is transferred to the cylinder liner 20, which is then transferred to the oil 62. As the oil 62 in the oil gallery 60 is replenished, heat is removed from the cylinder liner 20 and the engine block 24 with the flow of oil 62. It should be appreciated that the oil 62 disposed within the oil gallery 60 may or may not be the same oil that is used to lubricate the internal combustion engine 22.

The plurality of grooves 64 are spaced apart by bridging portions 65 of the outer surface 52 of the inner wall 52. In the embodiment shown in FIG. 2, the bridging portions 65 abut the cylinder bore 26 of the engine block 24 such that the plurality of grooves 64 are closed off by the cylinder bore 26. As such, in this configuration, the oil gallery 60 is formed by the plurality of grooves 64 on one side and the cylinder bore 26 on the other. In the embodiment shown in FIG. 4, the bridging portions 65 abut the sleeve 57 such that the plurality of grooves 64 are closed off by the sleeve 57. As such, in this configuration, the oil gallery 60 is formed by the plurality of grooves 64 on one side and the sleeve 57 on the other. Notwithstanding these examples, it should be appreciated that other configurations are envisioned where the bridging portions 65 in the outer face 52 of the liner wall 42 are spaced from either the cylinder bore 26 or the sleeve 57 such that the oil gallery 60 forms a continuous annular channel around the oil gallery surface 58 of the liner wall 42.

Although the plurality of grooves 64 may be formed, manufactured, or otherwise created by a number of different processes, by way of example and without limitation, the plurality of grooves 64 may be formed by cutting, etching, casting, and/or forging operations. Each groove 64 of said plurality of grooves 64 has a groove depth 66 and a groove width 68. The groove depth 66 (best seen in FIGS. 8A-B and FIGS. 9A-B) may generally be considered as equaling a distance that each groove 64 extends inwardly into the liner wall 42 from the outer face 52. As such, the groove depth 66 may alternatively be characterized as equaling a height of the bridging portions 65. The groove width 68 (best seen in FIGS. 5-7) may generally be considered as equaling a distance measured across each groove 64 (i.e. transverse to each groove 64) from the bridging portion 65 on one side of the groove 64 to the bridging portion 65 on an opposite side of the groove 64.

The plurality of grooves 64 in the liner wall 42 extend generally parallel to one another across the oil gallery surface 58. Accordingly, each bridging portion 65 has a bridging portion width 70. The bridging portion width 70 (best seen in FIGS. 5-7) may alternatively be characterized as a groove separation distance 70. The cylinder liner 20 further includes a plurality of fins 71 that are disposed within the plurality of grooves 64. The plurality of fins 71 are parallel to the plurality of grooves 64, and are arranged such that the plurality of fins 71 are spaced from the bridging portions 65. Each fin 71 extends radially outward from a base B to a tip T. The plurality of fins 71 function to further increase surface area of the oil gallery surface 58 of the liner wall 42 to promote greater heat transfer between the oil 62 in the oil gallery 60 and the liner wall 42. The plurality of fins 71 may be integral with the liner wall 42 or may be formed separately from the cylinder liner 20 and then subsequently attached to the liner wall 42. When the plurality of fins 71 are integral with the liner wall 42, the plurality of fins 71 may be formed as the plurality of grooves 64 are cut into the liner wall 42. In this case, the plurality of fins 71 are made from the first material 41 (i.e. the material that forms the cylinder liner 20). Where the plurality of fins 71 are separately formed, but attached to, the liner wall 42, the plurality of fins 71 may be made from either the first material 41 or a second material 73 that is different from the first material 41 (i.e. the material that forms the plurality of fins 71 may be different from the material that forms the cylinder liner 20). The second material 73 may be selected to have a higher thermal conductivity than the first material 41 to enhance heat transfer from the liner wall 42 to the oil 62 in the oil gallery 60. Although the separately formed fins 71 may be attached to the liner wall 42, in various ways, in several non-limiting examples, the fins 71 may be brazed, soldered, welded, or affixed to the liner wall 42 using fasteners or adhesive.

Figure 5:
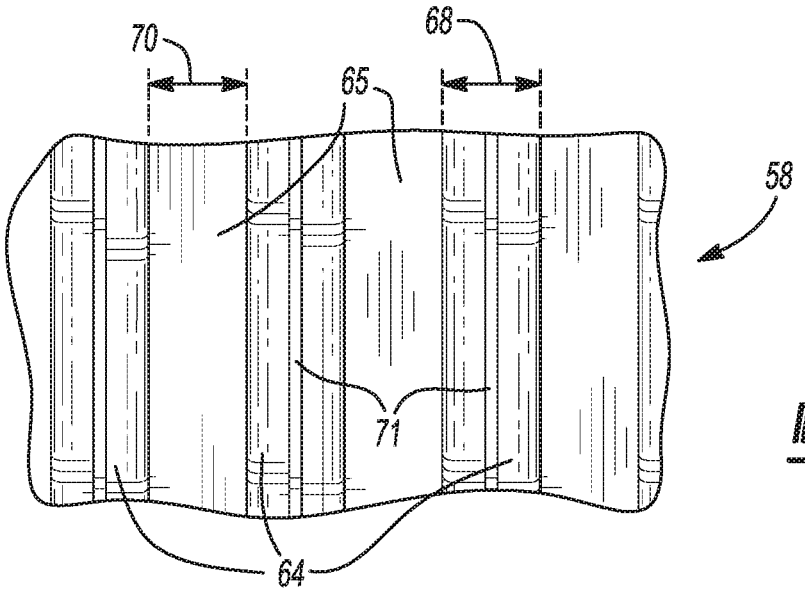
FIG. 5 is a partial front elevation view showing an exemplary arrangement of grooves in an oil gallery surface of the exemplary cylinder liner shown in FIG. 3.
Figure 6:
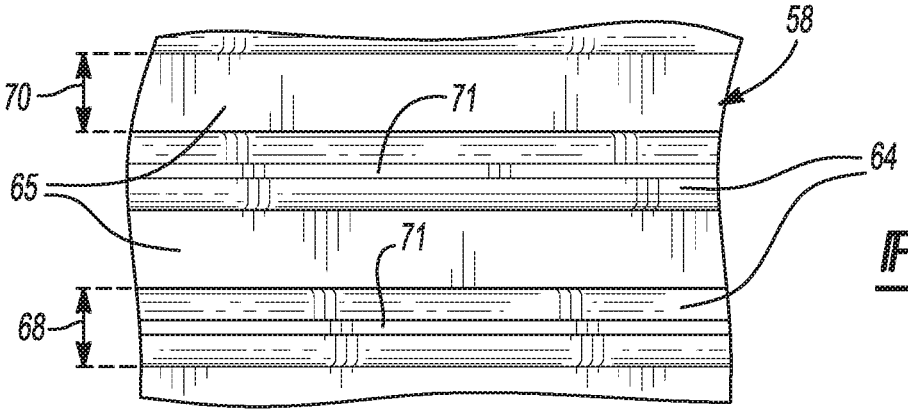
FIG. 6 is a partial front elevation view showing another exemplary arrangement of grooves in the oil gallery surface of another exemplary cylinder liner constructed in accordance with the subject disclosure.
Figure 7:
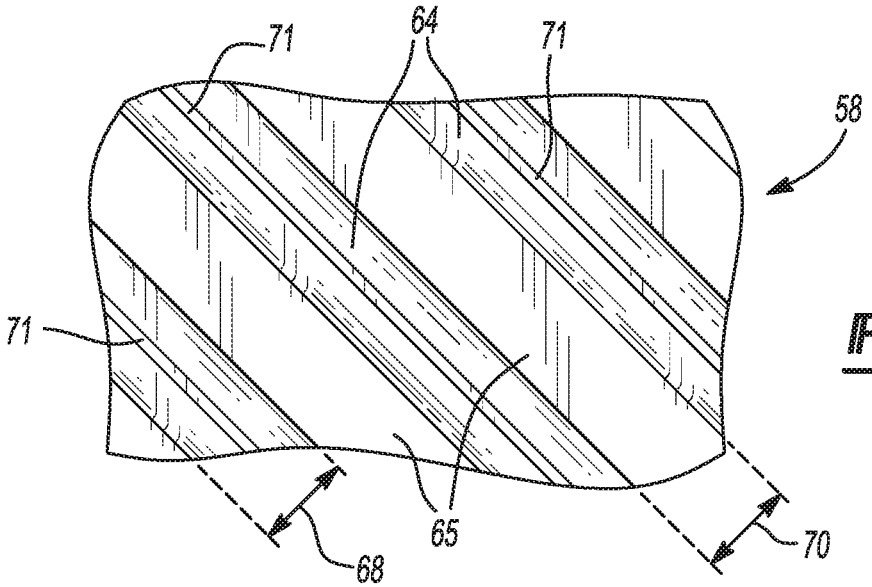
FIG. 7 is a partial front elevation view showing another exemplary arrangement of grooves in the oil gallery surface of another exemplary cylinder liner constructed in accordance with the subject disclosure.

With reference to FIGS. 5-7, the plurality of grooves 64 and the plurality of fins 71 may be arranged in a pattern that spans the oil gallery surface 58. In other words, the plurality of grooves 64 and the plurality of fins 71 may be spaced along the entire oil gallery surface 58 in a geometrically repetitious manner. Without departing from the scope of the present disclosure, the plurality of grooves 64 and the plurality of fins 71 may be formed in a variety of different shapes and the pattern in which the plurality of grooves 64 and the plurality of fins 71 are arranged may vary. Several examples are described herein and illustrated in FIGS. 5-7. It should be appreciated that these variations are merely exemplary and are not intended to be limiting. With reference to FIG. 5, the plurality of grooves 64 and the plurality of fins 71 may be configured to extend axially along the oil gallery surface 58 such that the plurality of grooves 64 and the plurality of fins 71 are parallel to the longitudinal axis A shown in FIG. 4. In the variation shown in FIG. 6, the multiple grooves 64 and the multiple fins 71 extend annularly along the oil gallery surface 58. When the cylinder liner 20 is vertically oriented as shown in FIGS. 3 and 4, the multiple grooves 64 illustrated in FIG. 6 will extend horizontally. Alternatively, the plurality of grooves 64 and the plurality of fins 71 may extend helically around the oil gallery surface 58 as shown in FIG. 7. It should be appreciated that in accordance with this configuration, the plurality of grooves 64 and the plurality of fins 71 may be formed by each turn of one or more helical structures that wrap around the liner wall 42. Accordingly, the multiple grooves 64 and the multiple fins 71 extend diagonally along the oil gallery surface 58. Where the cylinder liner 20 is vertically oriented as shown in FIGS. 3 and 4, the multiple grooves 64 and multiple fins 71 shown in FIG. 7 extend in a direction that includes both a horizontal component and a vertical component.

Figure 8A:
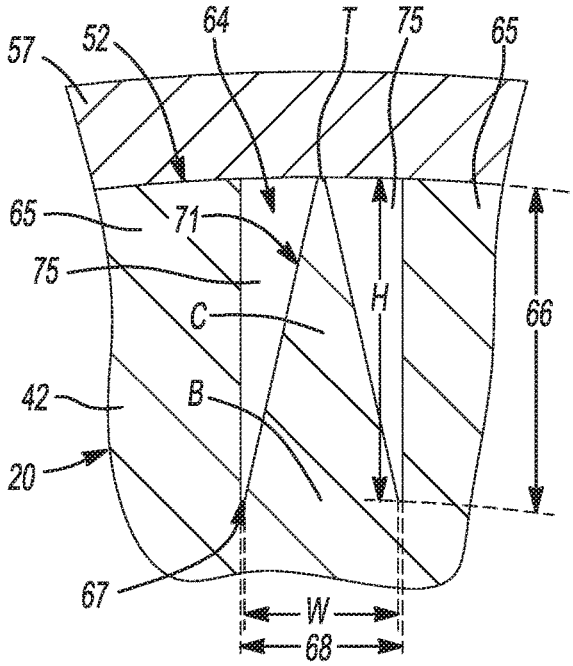
FIG. 8A is a partial section view of an exemplary cylinder liner showing the cross-section of one of the grooves in the oil gallery surface and the cross-section of an exemplary fin disposed inside the groove.

FIGS. 8A-B and FIGS. 9A-B are partial section views illustrating the cross-sections of various different fin arrangements. These different fin arrangements are exemplary in nature and are not exhaustive or limiting. The partial section views shown in FIGS. 8A-B and FIGS. 9A-B are taken transverse to the longitudinal axis A illustrated in FIG. 4. With reference to FIG. 8A, one fin 71 is provided per groove 64. The fin 71 illustrated in this embodiment has a generally triangular cross-sectional shape C with the tip T aligned, flush, or in a common plane with the outer surface 52 of the liner wall 42 and the base B disposed along the bottom 67 of the groove 64. The fin 71 also has a fin height H measured between the tip T and the base B and a maximum fin width W. In the configuration shown in FIG. 8A, the maximum fin width W is measured across the base B, but it should be appreciated that the maximum fin width W may not always be located along the base B depending upon the shape of the fin 71.

Figure 8B:
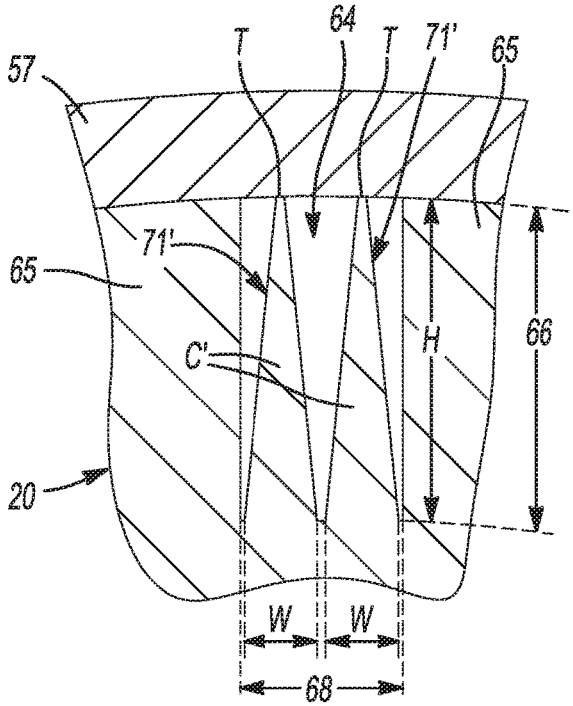
FIG. 8B is a partial section view of another exemplary cylinder liner similar to the one illustrated in FIG. 8A, but where two exemplary fins are disposed inside the groove.
Figure 9A:
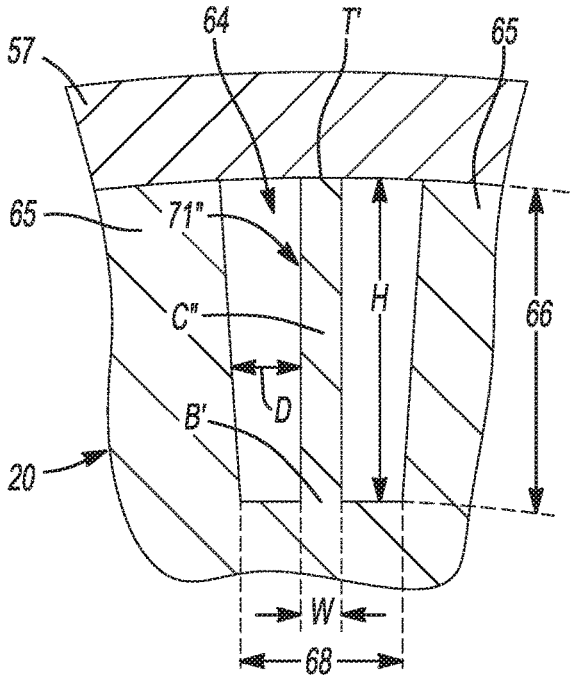
FIG. 9A is a partial section view of another exemplary cylinder liner similar to the one illustrated in FIG. 8A, but where the fin has a different cross-sectional shape.

FIG. 8B illustrates a variation where two fins 71' are provided per groove 64. Like in FIG. 8A, the fins 71' illustrated in FIG. 8B have generally triangular cross-sectional shapes C'. FIG. 9A illustrates another variation where a single fin 71" is provided in each groove 64. In this configuration, the fin 71" has a generally rectangular cross-sectional shape C". Again, the fin 71" has a tip T' and a base B'. It should be appreciated that in FIGS. 8A, 8B, and 9A, the fin height H equals the groove depth 66. As a result, the tips T, T' of the fins 71, 71', 71" may touch either the cylinder bore 26 (not shown) or the sleeve 57 (shown) such that the grooves 64 are divided into multiple groove segments 75. Together, the multiple groove segments 75 of each groove 64 form the oil gallery 60.

Figure 9B:
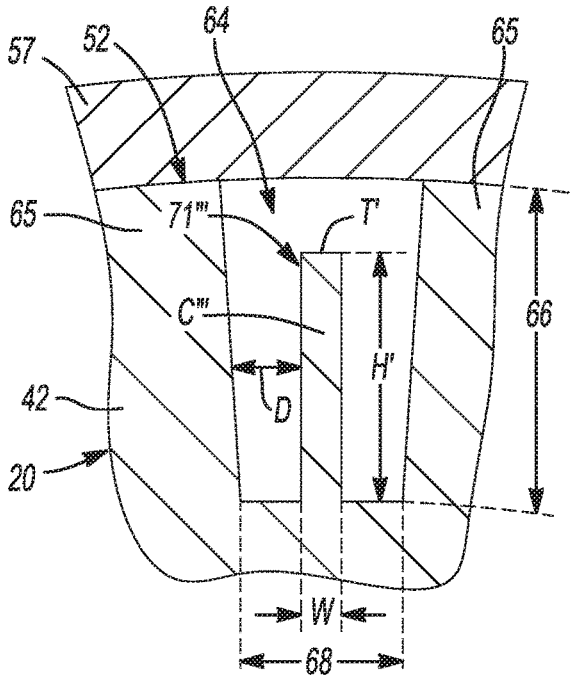
FIG. 9B is a partial section view of another exemplary cylinder liner similar to the one illustrated in FIG. 9A, but where the fin has a reduced height.

FIG. 9B illustrates another variation of the configuration shown in FIG. 9A. In FIG. 9B, a single fin 71'" is disposed in the groove 64. Like in FIG. 9A, the single fin 71'" illustrated in FIG. 9B has a generally rectangular cross-sectional shape C'". However, in FIG. 9B, the tip T' is inset relative to the outer surface 52 of the liner wall 42. As a result, the fin 71'" has a reduced fin height H' that is smaller than the groove depth 66. Because the tip T' is inset relative to the outer surface 52 of the liner wall 42, the tip T' remains spaced from either the cylinder bore 26 (not shown) or the sleeve 57 (shown) such that the fin 71'" does not divide the groove 64 into multiple segments. One benefit to this configuration is that the tip T' of the fin 71'" is exposed to the oil 62 in the groove 64, which increases the surface area of the fin 71'" that is exposed to the oil 62 for improved heat transfer. Importantly, it should be appreciated that in FIGS. 8A-B and FIGS. 9A-B, the fins 71, 71', 71" and 71'" are structurally distinct from the bridging portions 65 of the liner wall 42 because of the cross-sectional shapes C, C', C", C'" and/or because the maximum fin width W for each embodiment is less than (i.e. is narrower than) the bridging portion width 70. In other words, the fins 71, 71', 71", 71'" are narrower than the bridging portions 65. In FIGS. 8A-B and FIGS. 9A-B, the maximum fin width W is also smaller than the groove width 68. In addition, as indicated above, the fins 71, 71', 71" and 71'" may have a reduced fin height H' relative to the groove depth 66 and therefore relative to the height of the bridging portions 65.

In FIGS. 9A and 9B, the fins 71" and 71'" are spaced from the bridging portions 65 by a predetermined distance D. The plurality of grooves 64 in combination with the fins 71", 71'" have an aspect ratio, defined as a ratio of the predetermined distance D between the bridging portions 65 and the fins 71", 71'" to the groove depth 66. In accordance with the subject disclosure, the aspect ratio ranges from a lower limit to a higher limit. At the lower limit of the aspect ratio, the groove depth 66 is twice as large as the predetermined distance D between the bridging portions 65 and the fins 71", 71'". At the higher limit of the aspect ratio, the groove depth 66 is four times as large as the predetermined distance D between the bridging portions 65 and the fins 71", 71'". Therefore, the aspect ratio may be any value between and including the lower limit and the higher limit of the aspect ratio. For example, the aspect ratio may be selected such that the groove depth 66 is three times as large as the predetermined distance D. It should be appreciated that the size relationship specified by the aspect ratio is not dependent on the actual measured size of the groove depth 66 or the predetermined distance D between the bridging portions 65 and the fins 71", 71'". For example, when groove depth 66 increases, the predetermined distance D increases proportionally such that the aspect ratio remains unchanged. As such, it should be appreciated that the plurality of grooves 64 set forth in the subject disclosure are not limited to any particular measured size. Notwithstanding, in one example, the groove depth 66 may range from 0.3 millimeters to 1.5 millimeters while the predetermined distance D between the bridging portions 65 and the fins 71", 71'" may range from 0.1 millimeters to 0.5 millimeters.

Advantageously, the plurality of grooves 64 and the plurality of fins 71 increase the surface area of the oil gallery surface 58. The increased surface area of the oil gallery surface 58 improves heat transfer away from the liner wall 42 because more of the oil 62 within the oil gallery 60 comes into contact with the cylinder liner 20 for any given length of the oil gallery surface 58. This is advantageous because increased heat transfer away from the cylinder liner 20 allows engineers to overcome the significantly lower heat transfer coefficients of oil as compared to water or water and anti-freeze solutions. The specific geometries of the grooves 64 and the fins 71 disclosed herein, including the groove depth 66, the groove width 68, the bridging portion width 70, and/or the aspect ratio are critical to the cooling properties of the cylinder liner 20 and the suitability of the cylinder liner 20 for use with oil cooling. As a result of this design, the internal combustion engine 22 can be cooled effectively with oil 62 instead of with water or water and anti-freeze solutions. Because oil is a lubricant, shields against corrosion instead of causing it, and is not disruptive to the combustion of fuels, the oil 62 in the oil gallery 60 need not be kept separate from other parts of the internal combustion engine 22. This is not the case with water-cooled engines, where engine reliability depends on the integrity of seals that prevent water or water and anti-freeze solutions from escaping the water jacket (i.e. the water cooling passages in the block).

The benefits of using oil for engine cooling are particularly advantageous when applied to opposed-piston engines. Accordingly, the cylinder liner 20 of the subject disclosure is well suited for use in engines like the opposed-piston engine 100 illustrated in FIGS. 10-13. With reference to FIGS. 10-13, the opposed-piston engine 100 includes an engine block 110. It should be appreciated that in FIGS. 10-13, several intake, exhaust, cooling, and control components are not illustrated for the sake of simplicity. It should also be appreciated that the engine block 110 may be a one-piece engine block or alternatively may comprise multiple block segments that are held together by fasteners or other means of attachment such as welding or adhesives. The opposed-piston engine 100 may be of a variety of different types, including without limitation, a two-stroke engine or a four-stroke engine. Further, the opposed-piston engine 100 may be designed to run on one or more different fuels, including diesel fuel (e.g. a compression-ignition engine) and gasoline (e.g. a spark-ignition engine).

Figure 11:
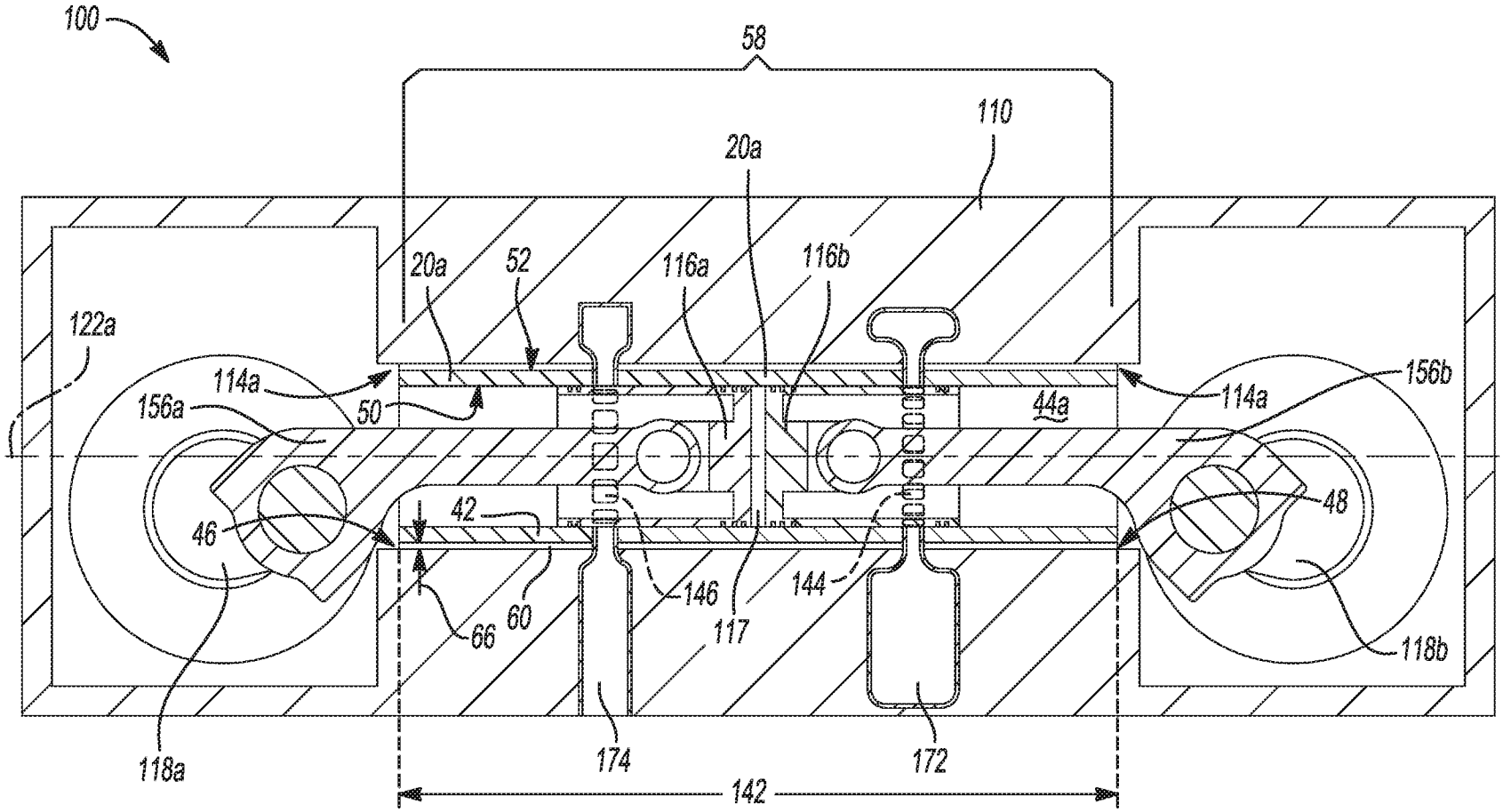
FIG. 11 is a side cross-sectional view of the exemplary opposed-piston engine illustrated in FIG. 10, which is taken along the longitudinal axis of a first cylinder liner, where a pair of pistons disposed in the first cylinder liner are shown at a top dead-center position.
Figure 12:
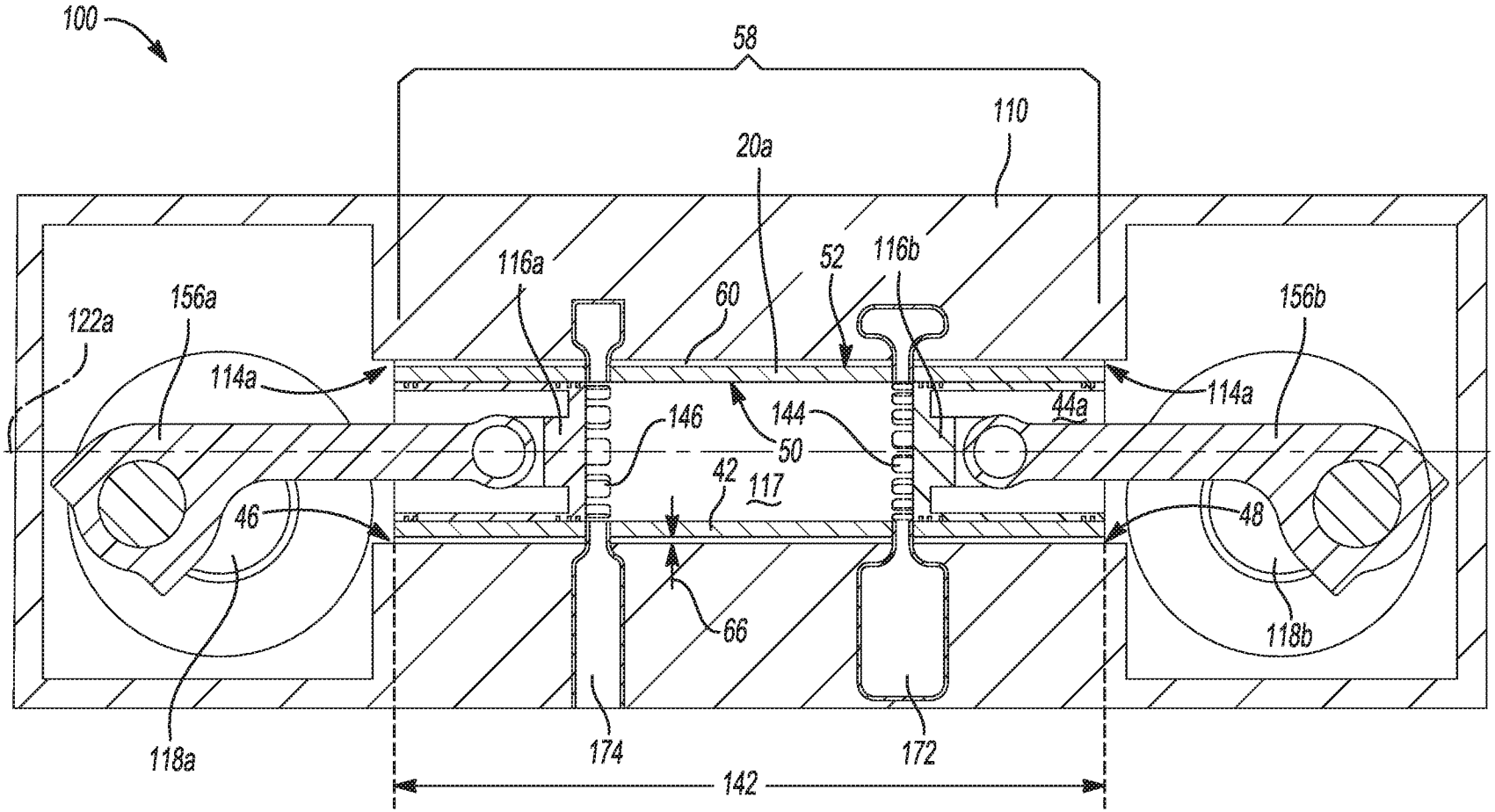
FIG. 12 is another side cross-sectional view of the exemplary opposed-piston engine illustrated in FIG. 10, which is taken along the longitudinal axis of the first cylinder liner, where the pair of pistons disposed in the first cylinder liner are shown at a bottom dead-center position.
Figure 13:
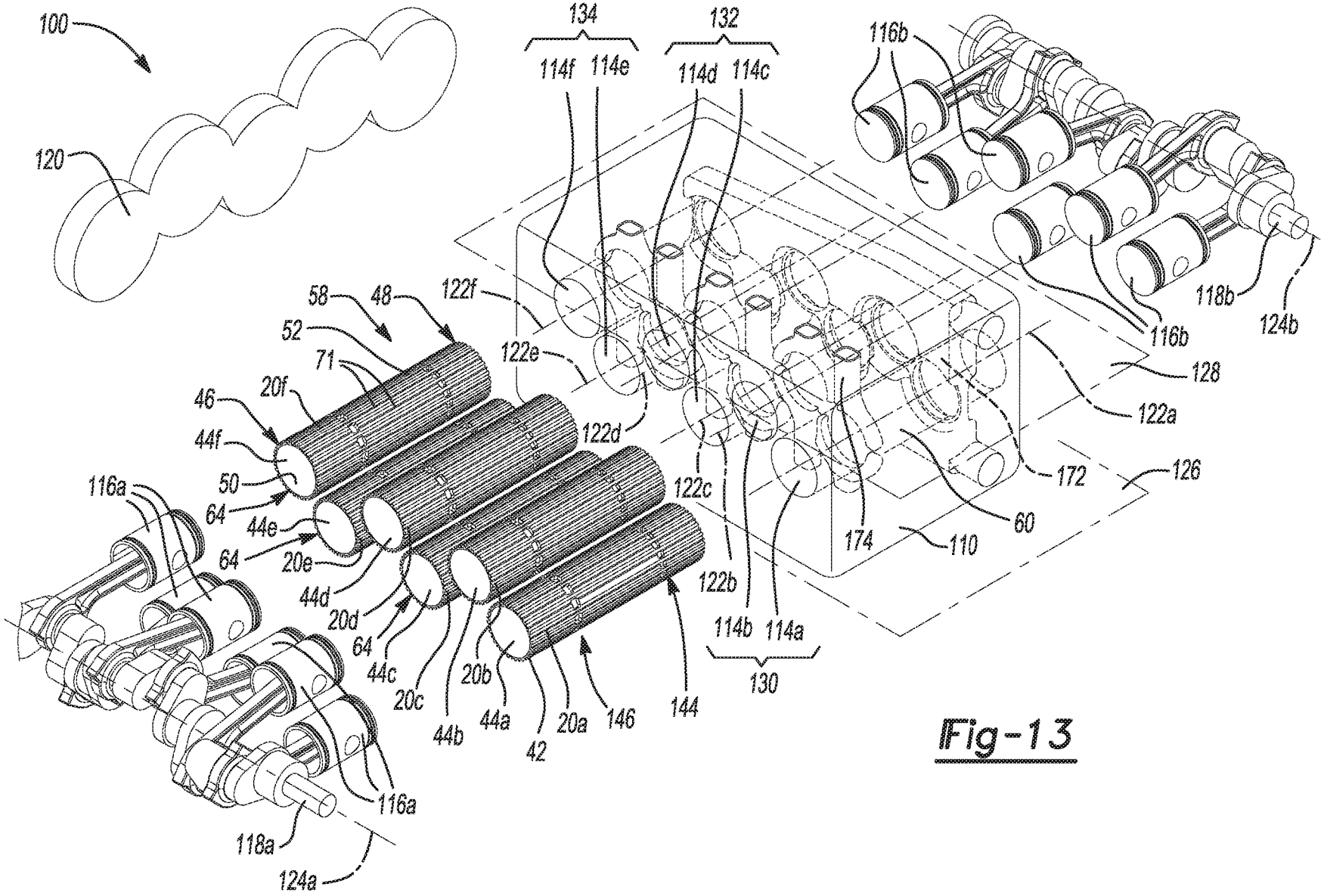
FIG. 13 is an exploded front perspective view of the exemplary opposed-piston engine illustrated in FIG. 10.

As best seen in FIGS. 11-13, the engine block 110 of the opposed-piston engine 100 may define a series of cylinder bores 114*a*-114*f*. Each cylinder includes a pair of pistons 116*a*, 116*b* slidably disposed therein. The pair of pistons 116*a*, 116*b* are movable toward one another and away from one another between a top dead-center position (FIG. 11) and a bottom dead-center position (FIG. 12). Accordingly, a combustion chamber 117 is formed in each of the cylinder bores 114*a*-114*f* between the pair of pistons 116*a*, 116*b* disposed in each one of the cylinder bores 114*a*-114*f*. Movement of the pistons 116*a*, 116*b* relative to and within the cylinder bores 114*a*-114*f* drives first and second crankshafts 118*a*, 118*b* which, in turn, drive a gear train 120. The gear train 120 may be connected to driven wheels of a vehicle (not shown), for example, whereby the first and second crankshafts 118*a*, 118*b* and the gear train 120 cooperate to transform the linear motion of the pistons 116*a*, 116*b* relative to the cylinder bores 114*a*-114*f* into rotational motion to allow the motion of the pistons 116*a*, 116*b* to rotate the driven wheels and propel the vehicle.

Figure 10:
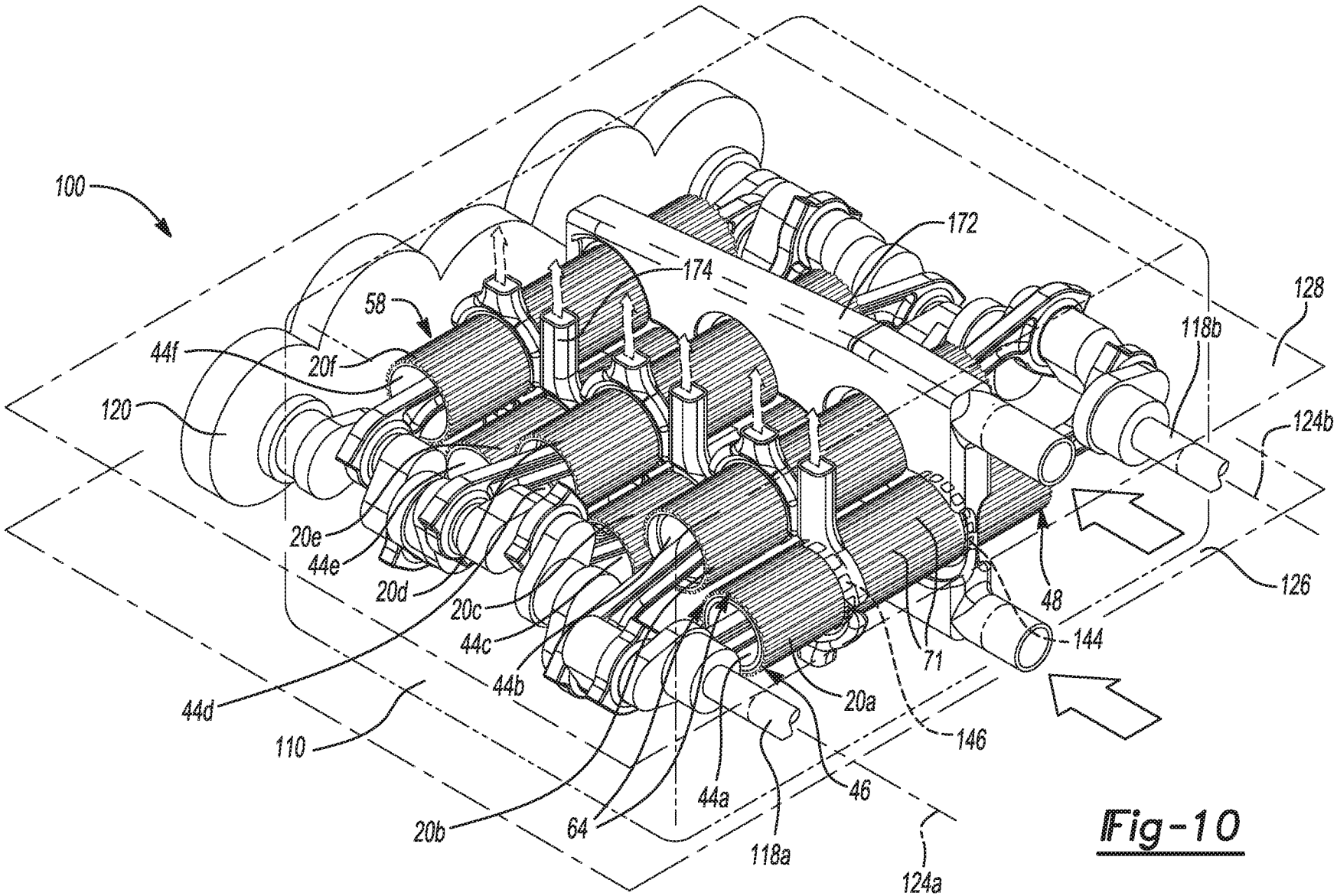
FIG. 10 is a partial front perspective view of an exemplary opposed-piston engine including exemplary cylinder liners that are constructed in accordance with the subject disclosure.

With reference to FIG. 13, the cylinder bores 114*a*-114*f* are housed within the engine block 110 and each includes a longitudinal axis 122*a*-122*f* that extends substantially perpendicular to a rotational axis 124*a*, 124*b* of each crankshaft 118*a*, 118*b*. As shown in FIGS. 10 and 13, the cylinder bores 114*a*-114*f* may be offset from one another such that the cylinder bores 114*a*-114*f* nest with one another. Longitudinal axes 122*a*, 122*c*, 122*e* of the cylinder bores 114*a*, 114*c*, 114*e* are aligned with one another such that a primary cylinder plane 126 intersecting each of longitudinal axes 122*a*, 122*c*, 122*e* of cylinder bores 114*a*, 114*c*, 114*e* is created. The primary cylinder plane 126 is spaced from and is substantially parallel to the rotational axes 124*a*, 124*b* of the first and second crankshafts 118*a*, 118*b*. Similarly, a secondary cylinder plane 128 intersecting longitudinal axes 122*b*, 122*d*, 122*f* of the cylinder bores 114*b*, 114*d*, 114*f* is created. The secondary cylinder plane 128 is spaced from and is substantially parallel to the rotational axes 124*a*, 124*b* of the first and second crankshafts 118*a*, 118*b*. The primary cylinder plane 126 is substantially parallel to and is offset from the secondary cylinder plane 128 and the primary cylinder plane 126 is disposed on an opposite side of the rotational axes 124*a*, 124*b* of the first and second crankshafts 118*a*, 118*b* than the secondary cylinder plane 128. Accordingly, this configuration of the cylinder bores 114*a*-114*f* creates the so-called "nested" arrangement, which allows the cylinder bores 114*a*-114*f* to be packaged in a smaller engine block 110. Notwithstanding, it should be appreciated that the scope of the present disclosure is not limited to this number of cylinders or the configuration illustrated in FIGS. 10-13. It should be appreciated that the cylinder bores 114*a*-114*f* do not have to be offset from one another. For example, the longitudinal axes 122*a*, 122*b* of cylinder bores 114*a*, 114*b* may be aligned in a plane (not shown) that is transverse to the primary and secondary cylinder planes 126, 128, the longitudinal axes 122*c*, 122*d* of cylinder bores 114*c*, 114*d* may be aligned in another plane (not shown) that is transverse to the primary and secondary cylinder planes 126, 128, and the longitudinal axes 122*e*, 122*f* of cylinder bores 114*e*, 114*f* may be aligned in yet another plane (not shown) that is transverse to the primary and secondary cylinder planes 126, 128. As such, cylinder bores 114*a*, 114*b* may be vertically stacked relative to one another, cylinder bores 114*c*, 114*d* may be vertically stacked relative to one another, and cylinder bores 114*e*, 114*f* may be vertically stacked relative to one another The cylinder bores 114*a*-114*f* of the opposed-piston engine 100 may be grouped into cylinder pairs where cylinder bores 114*a* and 114*b* are grouped in a first cylinder pair 130, cylinder bores 114*c* and 114*d* are grouped in a second cylinder pair 132, and cylinder bores 114*e* and 114*f* are grouped in a third cylinder pair 134. Because the relative structure and function of the first cylinder pair 130 is the same as the second and third cylinder pairs 132, 134, the following disclosure focuses on the first cylinder pair 130 with the understanding that the same also applies to the second and third cylinder pairs 132, 134 of the opposed-piston engine 100 illustrated in FIGS. 10-13.

As shown in FIGS. 10 and 13, a plurality of cylinder liners 20*a*-20*f* are disposed within the engine block 110. Each cylinder liner of the plurality of cylinder liners 20*a*-20*f* has the same features as those described above in connection with cylinder liner 20. Specifically, the liner wall 42 of each of the plurality of cylinder liners 20*a*-20*f* extends annularly about piston bores 44*a*-44*f* and axially between the first and second ends 46, 48. The first end 46 of each of the plurality of cylinder liners 20*a*-20*f* is disposed adjacent the first crankshaft 118*a* and the second end 48 of each of the plurality of cylinder liners 20*a*-20*f* is disposed adjacent the second crankshaft 118*b*. With additional reference to FIGS. 11 and 12, the inner face 50 of the liner wall 42 for of each of the plurality of cylinder liners 20*a*-20*f* defines the piston bores 44*a*-44*f* and the outer face 52 of the liner wall 42 for of each of the plurality of cylinder liners 20*a*-20*f* face the cylinder bores 114*a*-114*f* of the engine block 110. Accordingly, for of each of the plurality of cylinder liners 20*a*-20*f*, the outer face 52 of the liner wall 42 is oppositely arranged with respect to the inner face 50 of the liner wall 42 and the inner face 50 of the liner wall 42 presents a smooth cylindrical surface extending from the first end 46 of the liner wall 42 to the second end 48 of the liner wall 42. It should thus be appreciated that when the cylinder liners 20*a*-20*f* are installed in engine block 110, the inner face 50 of the liner wall 42 of each of the plurality of cylinder liners 20*a*-20*f* contacts the pistons pair of pistons 116*a*, 116*b*.

As described above, each of the plurality of cylinder liners 20*a*-20*f* has oil gallery surface 58 that is co-extensive with at least part of the outer face 52 of the liner wall 42. When the cylinder liners 20*a*-20*f* are installed in the cylinder bores 114*a*-114*f*, the oil gallery surface 58 of each of the plurality of cylinder liners 20*a*-20*f* is axially aligned with and exposed to the oil gallery 60 of the engine block 110. During operation of the opposed-piston engine 100, the oil 62 flowing through the oil gallery 60 cools the cylinder liners 20*a*-20*f* and the engine block 110. Although not required, the oil 62 disposed within the oil gallery 60 may also be used to lubricate other parts of the opposed-piston engine 100.

As shown in FIGS. 10-13, the cylinder liners 20*a*-20*f* of the opposed-piston engine 100 may include any one of the arrangements of the plurality of grooves 64 and the plurality of fins 71 described above in connection with cylinder liner 20. For each one of the cylinder liners 20*a*-20*f*, the plurality of grooves 64 and the plurality of fins 71 are disposed along the oil gallery surface 58 of the outer face 52. Therefore, the plurality of grooves 64 and the plurality of fins 71 are exposed to the oil gallery 60 and are in fluid communication with the oil gallery 60. As a result, the plurality of grooves 64 and the plurality of fins 71 cooperate to increase the surface area of the oil gallery surface 58 and improve heat transfer from the liner wall 42 to the oil 62 in the oil gallery 60.

FIGS. 11 and 12 illustrate a section view taken along the longitudinal axis 122*a* of cylinder bore 114*a*. In FIGS. 11 and 12, the outer face 52 of cylinder liner 20*a* abuts cylinder bore 114*a* of the engine block 110 such that the plurality of grooves 64 are closed off at the outer face 52 of the liner wall 42 by the cylinder bore 114*a*. As such, in this configuration, at least part of the oil gallery 60 is formed by the plurality of grooves 64 on one side and the cylinder bore 114*a* on the other. In FIGS. 10-13, each of the multiple grooves 64 and each of the multiple fins 71 extend longitudinally along the oil gallery surface 58 and are parallel to the longitudinal axis 122*a* of the cylinder bore 114*a*. Where the cylinder liners 20*a*-20*f* are horizontally oriented as shown in FIGS. 10-13, the multiple grooves 64 extend horizontally. Notwithstanding this illustrated embodiment, it should be appreciated that this embodiment is not limiting, but rather the various exemplary configurations illustrated herein or other non-illustrated configurations may be applied to the cylinder liners 20*a*-20*f* of the opposed-piston engine 100.

The geometric shape and dimensions of the plurality of grooves 64 and the plurality of fins 71 in the cylinder liners 20*a*-20*f* of the opposed-piston engine 100 are the same as the plurality of grooves 64 and the plurality of fins 71 discussed above in connection with cylinder liner 20. As noted above, the plurality of grooves 64 and the plurality of fins 71 in the liner wall 42 extend generally parallel to one another across the oil gallery surface 58 and are spaced apart from one another. It should also be appreciated that the plurality of grooves 64 and the plurality of fins 71 may be arranged in a pattern that spans all or only part of an axial length 142 of the cylinder liners 20*a*-20*f*. This axial length 142 is measurable between the first and second ends 46, 48 of each of the cylinder liners 20*a*-20*f*. In FIG. 3, the grooves 64 and the fins 71 have a length L that is less than the axial length of the cylinder liner 20. In FIG. 4, the grooves 64 and the fins 71 have a length L that is equal to the axial length of the cylinder liner 20. In various implementations, such as in the configuration shown in FIG. 14, the fins 71 may have a length L' that is less than the length L of the grooves 64. Advantageously, this arrangement exposes axial ends 148 of the fins 71 to oil 62 in the grooves 64 for greater surface area between the fins 71 and the oil 62 in the grooves 64 for improved heat transfer.

Each of the cylinder liners 20*a*-20*f* has an inlet port 144 and an exhaust port 146 that is longitudinally spaced from the inlet port 144. The inlet port 144 and the exhaust port 146 are arranged in fluid communication with the piston bores 44*a*-44*f* and may each be formed as one or more openings that extend through the liner wall 42 of the cylinder liners 20*a*-20*f* at a number of circumferentially spaced locations. Although the inlet and exhaust ports 144, 146 are present in each one of the cylinder liners 20*a*-20*f*, the functionality of the inlet and exhaust ports 144, 146 will be explained with reference to just the first cylinder liner 20*a* illustrated in FIGS. 11 and 12, with the understanding that the same applies to all of the cylinder liners 20*a*-20*f*. The pair of pistons 116*a*, 116*b* disposed in the piston bore 44*a* of the first cylinder liner 20*a* includes a first piston 116*a* and a first opposing piston 116*b*. The first piston 116*a* and the first opposing piston 116*b* are slidably disposed within the first cylinder liner 20*a* and are movable along the first longitudinal axis 122*a*. For example, the first piston 116*a* and the first opposing piston 116*b* may move toward one another along the first longitudinal axis 122*a* in a first mode of operation and away from one another along the first longitudinal axis 122*a* in a second mode of operation as the first piston 116*a* and the first opposing piston 116*b* translate between the top dead-center position (shown in FIG. 11) and the bottom dead-center position (shown in FIG. 12). Accordingly, the first mode of operation and the second mode of operation occur sequentially during a single engine cycle.

Where the opposed-piston engine 100 is a two-stroke engine, the first mode of operation and the second mode of operation comprise the entirety of the single engine cycle. The intake charge is compressed during the first mode of operation and the intake charge ignites during the second mode of operation where the pair of pistons 116*a*, 116*b* are driven apart and where a new intake charge enters the piston bore 44*a* and the exhaust gases are expelled. Alternatively, where the opposed-piston engine 100 is a four-stroke engine, the single engine cycle may include two of the first modes of operation and two of the second modes of operation. The single engine cycle may begin with the second mode of operation where the intake charge enters the piston bore 44*a* as the pair of pistons 116*a*, 116*b* move apart. The intake charge is then compressed in the first mode of operation where the pistons 116*a*, 116*b* approach one another. The intake charge ignites in the combustion chamber 117 that is formed between the pair of pistons 116*a*, 116*b* and the combustion forces the pair of pistons 116*a*, 116*b* apart in another second mode of operation. Next, the pair of pistons 116*a*, 116*b* move in another first mode of operation where the pistons 116*a*, 116*b* again approach one another to expel exhaust gases out of the piston bore 44*a*.

Referring to FIGS. 11 and 12, the first piston 116*a* is connected to the first crankshaft 118*a* by a first connecting rod 156*a*. In response to reciprocal motion of the first piston 116*a* within the piston bore 44*a* along the first longitudinal axis 122*a*, the first crankshaft 118*a* rotates about the first axis of rotation 124*a* (shown in FIGS. 10 and 13). The first axis of rotation 124*a* generally extends along the first crankshaft 118*a* and is transverse to the first longitudinal axis 122*a*. The first opposing piston 116*b* is connected to the second crankshaft 118*b* by a second connecting rod 156*b*. In response to reciprocal motion of the first opposing piston 116*b* within the piston bore 44*a* along the first longitudinal axis 122*a*, the second crankshaft 118*b* rotates about the second axis of rotation 124*b* (shown in FIGS. 10 and 13). The second axis of rotation 124*b* generally extends along the second crankshaft 118*b* and is transverse to the first longitudinal axis 22*a*. With additional reference to FIGS. 10 and 13, the pistons 116*a*, 116*b* in the other cylinder liners 20*b*-20*f* are coupled to the first and second crankshafts 118*a*, 118*b* in a similar manner. In some case, the arrangement of the first and second crankshafts 118*a*, 118*b* may be selected such that the movement of the pair of pistons 116*a*, 116*b* disposed in cylinder liner 20*a* opposes the movement of the pair of pistons 116*a*, 116*b* disposed in cylinder liner 20*b*. In accordance with such an arrangement, the pair of pistons 116*a*, 116*b* disposed in cylinder liner 20*a* will be moving in the first mode of operation as the pair of pistons 116*a*, 116*b* disposed in cylinder liner 20*b* are moving in the second mode of operation and vice versa. The first and second connecting rods 156*a*, 156*b* shown in FIGS. 11 and 12 have a bent geometry relative to the first longitudinal axis 112*a*, but it should be appreciated that other geometries are possible, including without limitation, geometries that are not bent (i.e. geometries that are straight).

The inlet ports 144 in the cylinder liners 20*a*-20*f* may be axially aligned with one another and similarly, the exhaust ports 146 in the cylinder liners 20*a*-20*f* may be axially aligned with one another. An inlet manifold 172 may thus be arranged in fluid communication with the inlet ports 144 in the cylinder liners 20*a*-20*f*. During operation of the opposed-piston engine 100, the inlet manifold 172, which extends through the engine block 110 transports air or an air/fuel mixture to the inlet ports 144 in the cylinder liners 20*a*-20*f*, which may be opened and closed by the movement of the pair of pistons 116*a*, 116*b*. Similarly, an exhaust manifold 174 may be arranged in fluid communication with the exhaust ports 146 in the cylinder liners 20*a*-20*f*. During operation of the opposed-piston engine 100, the exhaust manifold 174, which also extends through the engine block 110 transports exhaust expelled from the combustion chamber 117 through the exhaust ports 146 in the cylinder liners 20*a*-20*f*. Like the inlet ports 144, the exhaust ports 146 may be opened and closed by the movement of the pair of pistons 116*a*, 116*b*.

FIGS. 11 and 12 generally illustrate the operation of the opposed-piston engine 100. An intake charge of air or an air/fuel mixture is supplied to piston bore 44*a* of the opposed-piston engine 100 through the inlet manifold 172 and the inlet port 144 in cylinder liner 20*a*. This intake charge undergoes combustion within the combustion chamber 117 of the piston bore 44*a*. Combustion of the intake charge produces exhaust gasses which exit the piston bore 44*a* through the exhaust port 146 in cylinder liner 20*a*. Where the opposed-piston engine 100 is a two-stroke engine, the intake charge is compressed by the pair of pistons 116*a*, 116*b* during the first mode of operation. This compression may cause the intake charge to ignite when the pair of pistons 116*a*, 116*b* are at or near the top dead-center position, as shown in FIG. 11. The resulting combustion of the intake charge drives the pair of pistons 116*a*, 116*b* apart during the second mode of operation. Alternatively, spark ignition may be used to control ignition of the intake charge during the first mode of operation. As the pair of pistons 116*a*, 116*b* are driven apart during the second mode of operation, the pair of pistons 116*a*, 116*b* pass by the inlet port 144 and the exhaust port 146 in the cylinder liner 20*a* as the pair of pistons 116*a*, 116*b* move to the bottom dead-center position, as shown in FIG. 12. In accordance with the outward movement of the pair of pistons 116*a*, 116*b*, the inlet port 144 and the exhaust port 146 are opened and become exposed to the combustion chamber 117. Exhaust gases thus exit the piston bore 44*a* through the exhaust port 146 in the cylinder liner 20*a* and a new intake charge enters the combustion chamber 117 in the piston bore 44*a* through the inlet port 144 in the cylinder liner 20*a* such that the engine cycle may begin anew. Alternatively, it should be appreciated that the inlet and exhaust ports 144, 146 may be open and closed by valves (not shown) instead of by the movement of the pair of pistons 116*a*, 116*b*. The same sequence occurs in the other piston bores 44*b*-44*f*, except at different times. For example, movement of the pair of pistons 116*a*, 116*b* disposed in cylinder liner 20*a* may be phased 180 degrees apart from movement of the pair of pistons 116*a*, 116*b* in cylinder liner 20*b* such that the pair of pistons 116*a*, 116*b* in cylinder liner 20*a* reach the top dead-center position just as the pair of pistons 116*a*, 116*b* in cylinder liner 20*b* reach the bottom dead-center position.

Normally, the opposed-piston engine 100 would have a plurality of seals (not shown) provided in or along the engine block 110 to seal against the inlet and exhaust manifolds 172, 174. These seals are required when the opposed-piston engine 100 is cooled with water or a water and anti-freeze solution because the water or a water and anti-freeze solution could otherwise leak out from the water jacket (not shown) and into the piston bores 44*a*-44*f* at the locations where the inlet and exhaust manifolds 172, 174 meet the cylinder liners 20*a*-20*f* (i.e. at the inlet and exhaust ports 144, 146). In accordance with the subject disclosure, these seals can be eliminated because the oil 62 in the oil gallery 60, which replaces the water or water and anti-freeze solution that is normally used for cooling, does not cause corrosion and does not negatively impact lubrication or combustion in the combustion chamber 117. To this end, the plurality of grooves 64 and the plurality of fins 71 provided along the oil gallery surface 58 of the cylinder liners 20*a*-20*f* allow oil to be effectively used for cooling in the opposed-piston engine 100, since the plurality of grooves 64 and the plurality of fins 71 increase the surface area of the oil gallery surface 58 enough to overcome the lower heat transfer coefficient of the oil 62 as compared to the higher heat transfer coefficients of water or a water and anti-freeze solution.

Figure 14:
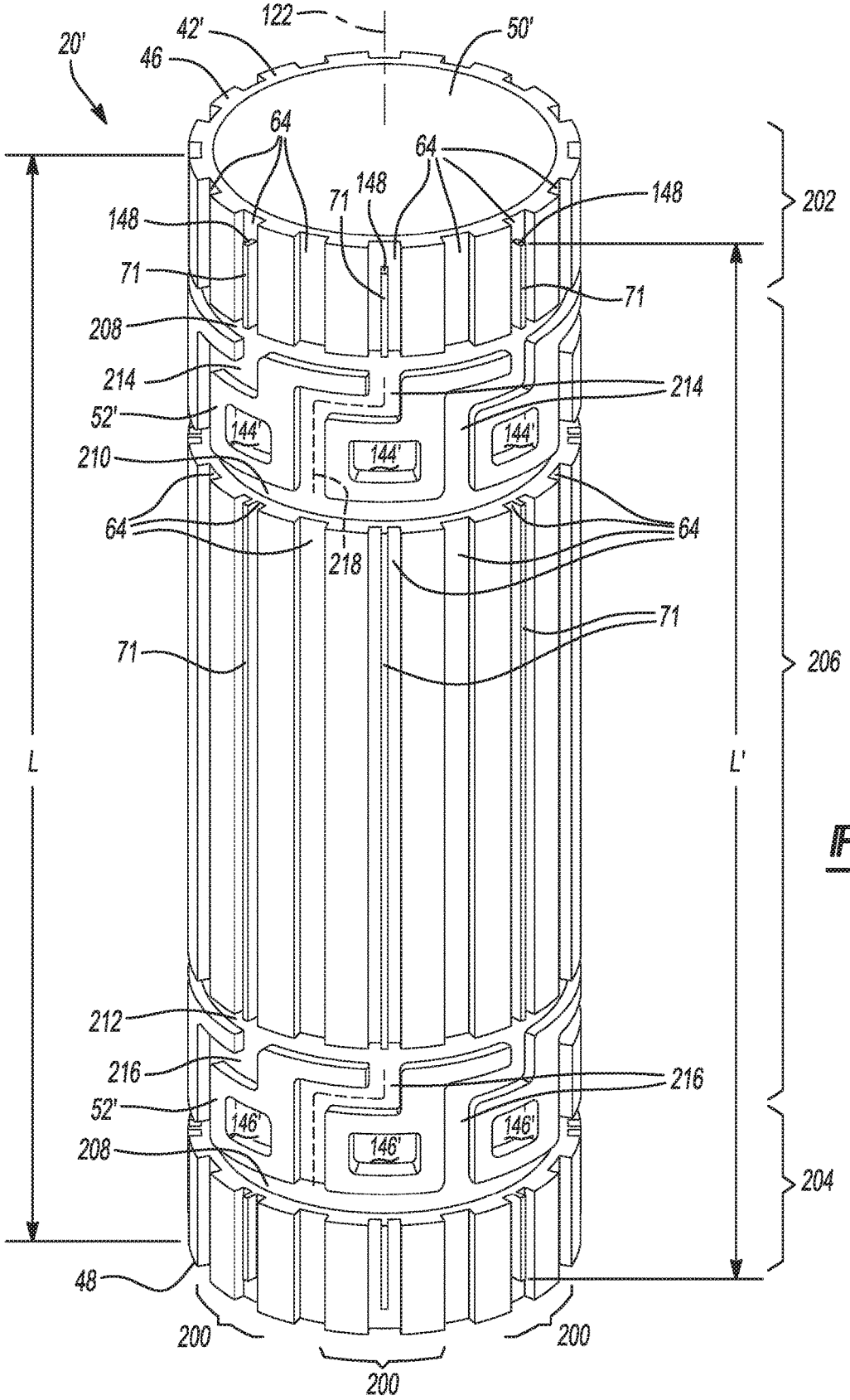
FIG. 14 is a front perspective view of another exemplary cylinder liner that is constructed for use in the exemplary opposed-piston engine illustrated in FIG. 10.

As best seen in FIG. 13, the plurality of grooves 64 and the plurality of fins 71 may be disposed around each of the cylinder liners 20*a*-20*f* at a number of circumferentially spaced locations. In the illustrated example, each of the grooves 64 is provided with one fin 71 disposed therein. An alternative configuration is illustrated in FIG. 14. FIG. 14 illustrates a modified cylinder liner 20' for the opposed-piston engine 100 shown in FIG. 10. The modified cylinder liner 20' has a liner wall 42' with an inner face 50' and an outer face 52'. Inlet and exhaust ports 144', 146' extend through the liner wall 42' at locations that are circumferentially aligned with one another. Each of the inlet and exhaust ports 144', 146' extends across a limited circumferential extent 200 of the liner wall 42'. Like in the configuration illustrated in FIGS. 10-13, the plurality of grooves 64 are disposed around the cylinder liner 20' at a number of circumferentially spaced locations. However, in the configuration illustrated in FIG. 14, the fins 71 are disposed in only those grooves 64 that are circumferentially aligned with the inlet and exhaust ports 144', 146'. In other words, the fins 71 are disposed in only the grooves 64 that are within the limited circumferential extent 200 of the liner wall 42'. While the limited circumferential extent 200 must be less than 360 degrees, it may be configured in a number of different ways. In the non-limiting example illustrated in FIG. 14, the limited circumferential extent 200 of the liner wall 42' is 30 degrees. Other arrangements are also possible where fins 71 are disposed in all of the grooves 64, but where the grooves 64 within the limited circumferential extent 200 of the liner wall 42' are provided with a greater number of fins 71 compared to the grooves 64 outside the limited circumferential extent 200 of the liner wall 42. This functions to increase heat transfer away from the liner wall 42' in the vicinity of the inlet and exhaust ports 144', 146', where cooling is often most critical. It should also be appreciated that similar arrangements can be provided to the cylinder liner 20 shown in FIGS. 1-4.

The inlet and exhaust ports 144', 146' shown in FIG. 14 generally delimit three distinct portions of the modified cylinder liner 20': a first end portion 202, a second end portion 204, and a medial portion 206. The first end portion 202 of the modified cylinder liner 20' extends between the first end 46 and the inlet ports 144'. The second end portion 204 of the modified cylinder liner 20' extends between the second end 48 and the exhaust ports 146'. The medial portion 206 extends between the inlet and exhaust ports 144', 146'. It should be appreciated that in the arrangement shown in FIG. 14, the grooves 64 and the fins 71 extend along the first end portion 202, the second end portion 204, and the medial portion 206 of the modified cylinder liner 20'. The first and second end portions 202, 204 of the modified cylinder liner 20' each include an outboard annular channel 208 that extends circumferentially about the liner wall 42'. The outboard annular channel 208 in the first end portion 202 is positioned between the grooves 64 and fins 71 of the first end portion 202 and the inlet ports 144'. The outboard annular channel 208 in the second end portion 204 is positioned between the grooves 64 and fins 71 of the second end portion 204 and the exhaust ports 146'. The medial portion 206 of the modified cylinder liner 20' includes first and second inboard annular channels 210, 212 that extend circumferentially about the liner wall 42. The first inboard annular channel 210 is positioned between the grooves 64 and fins 71 of the medial portion 206 and the inlet ports 144' and the second inboard annular channel 212 is positioned between the grooves 64 and fins 71 of the medial portion 206 and the exhaust ports 146'.

The modified cylinder liner 20' shown in FIG. 14 further includes a first plurality of transfer channels 214 that are circumferentially spaced between adjacent inlet ports 144' and a second plurality of transfer channels 216 that are circumferentially spaced between adjacent exhaust ports 146'. The first plurality of transfer channels 214 extend between the outboard annular channel 208 in the first end portion 202 and the first inboard annular channel 210 in the medial portion 206 of the modified cylinder liner 20'. The second plurality of transfer channels 216 extend between the outboard annular channel 208 in the second end portion 204 and the second inboard annular channel 212 in the medial portion 206 of the modified cylinder liner 20'. The first plurality of transfer channels 214 and the second plurality of transfer channels 216 follow a non-linear path 218. The non-linear path 218 extends both circumferentially along a portion of the liner wall 42' and longitudinally in a direction that is parallel to the longitudinal axis 122 of the modified cylinder liner 20'. The grooves 64 in the first end portion 202 of the modified cylinder liner 20' and the first plurality of transfer channels 214 are open to and disposed in fluid communication with the outboard annular channel 208 in the first end portion 202. The grooves 64 in the medial portion 206 of the modified cylinder liner 20' and the first plurality of transfer channels 214 are open to and disposed in fluid communication with the first inboard annular channel 210. The grooves 64 in the second end portion 204 of the modified cylinder liner 20' and the second plurality of transfer channels 216 are open to and disposed in fluid communication with the outboard annular channel 208 in the second end portion 204. The grooves 64 in the medial portion 206 of the modified cylinder liner 20' and the second plurality of transfer channels 216 are open to and disposed in fluid communication with the second inboard annular channel 212. It should also be appreciated that the grooves 64, the outboard annular channels 208, the first and second inboard channels 210, 212, the first plurality of transfer channels 214, and the second plurality of transfer channels 216 are all open to the outer face 52' of the liner wall 42' and therefore define fluid passageways between the liner wall 42' and the engine block 110 of the opposed piston engine 100.

Fluid (such as a coolant and/or lubricant) can flow from the first end 46 of the modified cylinder liner 20' to the second end 48 of the modified cylinder liner 20'. Advantageously, the non-linear path 218 that the first plurality of transfer channels 214 and the second plurality of transfer channels 216 follow increases the length of the first plurality of transfer channels 214 and the second plurality of transfer channels 216 in the vicinity of the inlet and exhaust ports 144', 146' for increased heat transfer and cooling. At the same time, the outer face 52' of the liner wall 42' remains uninterrupted adjacent the inlet and exhaust ports 144', 146' to prevent the fluid flowing through the grooves 64 from entering the inlet and exhaust ports 144', 146'.

The subject disclosure also contemplates a method of cooling cylinder liner 20 and cylinder liners 20*a*-20*f* described above. The method includes the step of passing the oil 62 through the oil gallery 60. As explained above, the oil gallery 60 is disposed between the engine block 24 and the cylinder liner 20 in FIGS. 1-9 and between the engine block 110 and the cylinder liners 20*a*-20*f* in FIGS. 10-13. The method also includes the steps of increasing heat transfer between cylinder liner 20 and cylinder liners 20*a*-20*f* and the oil 62 passing through the oil gallery 60 by providing cylinder liner 20 and cylinder liners 20*a*-20*f* with the plurality of grooves 64 in the oil gallery surface 58 and providing each groove 64 with one or more of the fins 71 disclosed above. The oil gallery surface 58 is disposed in contact with the oil 62 and the plurality of grooves 64 in the oil gallery surface 58 extend inwardly into the liner wall 42. The plurality of grooves 64 are separated by the bridging portions 65 and the maximum fin width W of the fins 71 is less than the bridging portion width 70.

As previously explained, the aspect ratio of the plurality of grooves 64 and the plurality of fins 71 may be selected such that the groove depth 66 is at least twice as large as the predetermined distance D between the bridging portions 65 of the liner wall 42 and the fins 71 and is no more than four times as large as the predetermined distance D between the bridging portions 65 of the liner wall 42 and the fins 71. As such, this step may include: selecting the aspect ratio such that the groove depth 66 is three times as large as the predetermined distance D, selecting the groove depth 66 to be at least 0.3 millimeters and no more than 1.5 millimeters, and/or selecting the predetermined distance D to be at least 0.1 millimeters and no more than 0.5 millimeters. The method may also include the additional step of manufacturing the plurality of grooves 64 in the oil gallery surface 58 such that the plurality of grooves 64 extend parallel to one another and are spaced apart by the bridging portion width 70. Further, the method may include the step of selecting the bridging portion width 70 to be at least as large as the groove width 68 and no more than five times larger than the groove width 68.

Many modifications and variations of the present invention are possible in light of the above teachings and may be practiced otherwise than as specifically described while within the scope of the appended claims. These antecedent recitations should be interpreted to cover any combination in which the inventive novelty exercises its utility. With respect to the methods set forth herein, the order of the steps may depart from the order in which they appear without departing from the scope of the present disclosure and the appended method claims.

Additionally, various steps of the method may be performed sequentially or simultaneously in time.

What is claimed is:

1. A cylinder liner comprising:

a liner wall that extends annularly about a piston bore;

said liner wall having an inner face adjacent said piston bore and an outer face that is oppositely arranged with respect to said inner face;

said outer face of said liner wall including an oil gallery surface that is co-extensive with at least part of said outer face;

a plurality of grooves disposed along said oil gallery surface that extend inwardly into said liner wall to increase a surface area of said oil gallery surface and that run parallel to each other;

each groove of said plurality of grooves having a groove depth and a groove width;

said plurality of grooves being spaced apart by bridging portions of said liner wall, said bridging portions having a bridging portion width; and at least one of said grooves in said plurality of grooves having at least one fin disposed therein that runs parallel to said plurality of grooves, each fin having a maximum fin width that is smaller than said groove width and said bridging portion width, wherein said groove width equals a distance measured across each groove from a bridging portion on one side of said groove to another bridging portion on an opposite side of said groove, wherein said bridging portion width and said maximum fin width both run parallel to said groove width.

2. The cylinder liner as set forth in claim 1, wherein said at least one fin extends radially from a base to a tip and has a fin height measured between said base and said tip.

3. The cylinder liner as set forth in claim 2, wherein said fin height equals said groove depth such that said tip of said at least one fin is flush with said outer surface of said liner wall.

4. The cylinder liner as set forth in claim 2, wherein said fin height is less than said groove depth such that said tip of said at least one fin is inset relative to said outer surface of said liner wall.

5. The cylinder liner as set forth in claim 2, wherein said at least one fin has a triangular cross-sectional shape with said maximum fin width being located at said base and said at least one fin gradually narrowing towards said tip.

6. The cylinder liner as set forth in claim 2, wherein said at least one fin has a rectangular cross-sectional shape such that said maximum fin width is consistent throughout said at least one fin from said base to said tip.

7. The cylinder liner as set forth in claim 1, wherein said at least one fin is circumferentially spaced from adjacent bridging portions by a predetermined distance, and wherein an aspect ratio is defined as a ratio of said groove depth to said predetermined distance.

8. The cylinder liner as set forth in claim 7, wherein said aspect ratio ranges from a lower limit where said groove depth is twice as large as said predetermined distance to a higher limit where said groove depth is four times as large as said predetermined distance.

9. The cylinder liner as set forth in claim 7, wherein said groove depth ranges from 0.3 millimeters to 1.5 millimeters and said predetermined distance ranges from 0.1 millimeters to 0.5 millimeters.

10. The cylinder liner as set forth in claim 1, wherein said at least one fin is a separate component that is attached to said liner wall.

11. The cylinder liner as set forth in claim 10, wherein said liner wall is made of a first material and said at least one fin is made of a second material that is different than said first material, said second material having a higher thermal conductivity than said first material.

12. The cylinder liner as set forth in claim 10, wherein said at least one fin is brazed on to said liner wall.

13. The cylinder liner as set forth in claim 1, wherein said at least one fin is integral with said liner wall.

14. The cylinder liner as set forth in claim 1, wherein said groove depth equals a distance that each of said grooves extends radially inwardly into said liner wall from said outer face, said groove width equals a distance measured circumferentially across each of said grooves between adjacent bridging portions, said bridging portion width equals a distance measured circumferentially across each of said bridging portions between adjacent grooves, and said maximum fin width equals a distance measured circumferentially across said at least one fin.

15. The cylinder liner as set forth in claim 1, wherein each groove in said plurality of grooves includes one fin that is centrally located therein.

16. The cylinder liner as set forth in claim 1, wherein each groove in said plurality of grooves includes two fins that are spaced apart from each other.

17. The cylinder liner as set forth in claim 1, wherein said plurality of grooves extend across said oil gallery surface of said liner wall in a geometrically repetitious pattern and run in one of an axial, annular, diagonal, or helical direction relative to a longitudinal axis of said piston bore.

18. The cylinder liner as set forth in claim 1, wherein said bridging portions of said liner wall abut a cylinder bore of an engine block when said cylinder liner is disposed within said cylinder bore such that said plurality of grooves are closed off by said cylinder bore and cooperate to form an oil gallery configured to receive oil for cooling.

19. The cylinder liner as set forth in claim 1, wherein said bridging portions of said liner wall abut a sleeve disposed within a cylinder bore of an engine block when said cylinder liner is inserted into said sleeve such that said plurality of grooves are closed off by said sleeve and cooperate to form an oil gallery configured to receive oil for cooling.

20. The cylinder liner as set forth in claim 1, wherein multiple grooves of said plurality of grooves have at least one fin disposed therein.

21. The cylinder liner as set forth in claim 1, wherein said at least one fin has a length that is less than a length of said plurality of grooves to expose an axial end of said at least one fin to oil in said plurality of grooves for improved heat transfer.

22. The cylinder liner as set forth in claim 1, wherein said liner wall includes a plurality of ports, each port extending across a limited circumferential extent of said liner wall and radially through said liner wall from said outer face to said inner face of said liner wall.

23. The cylinder liner as set forth in claim 22, wherein said liner wall includes a plurality of transfer channels that are circumferentially spaced between adjacent ports in said plurality of ports, said plurality of transfer channels extending in a non-linear path around said plurality of ports.

24. The cylinder liner as set forth in claim 22, wherein only grooves that are circumferentially aligned with said ports include one or more fins.

25. An opposed-piston engine assembly comprising:

an engine block defining at least one cylinder bore that extends along a longitudinal axis;

a cylinder liner received within said cylinder bore of said engine block;

said cylinder liner having a liner wall that extends annularly about a piston bore;

first and second crankshafts disposed at opposite ends of said cylinder liner;

a pair of pistons slidingly disposed in said piston bore of said cylinder liner that are movable along said longitudinal axis toward one another in a first mode of operation and away from one another along said longitudinal axis in a second mode of operation;

a combustion chamber disposed within said piston bore between said pair of pistons;

said liner wall having an inner face adjacent said piston bore and an outer face that is oppositely arranged with respect to said inner face;

said outer face of said liner wall including an oil gallery surface that is co-extensive with at least part of said outer face;

a plurality of grooves disposed along said oil gallery surface that are parallel to each other and that extend inwardly into said liner wall, said plurality of grooves cooperatively defining an oil gallery for operably receiving oil; and a plurality of fins extending along said liner wall at locations disposed within at least some of said grooves in said plurality of grooves to increase a surface area of said oil gallery surface and improve heat transfer from said liner wall to said oil disposed in said oil gallery, said plurality of fins being parallel to said plurality of grooves.

26. The opposed-piston engine assembly as set forth in claim 25, wherein each groove of said plurality of grooves has a groove depth and a groove width and each fin of said plurality of fins has a fin width that is smaller than said groove width.

27. The opposed-piston engine assembly as set forth in claim 25, wherein each groove of said plurality of grooves and each fin of said plurality of fins extends linearly along said oil gallery surface and parallel to said longitudinal axis of said at least one cylinder bore.

28. A cylinder liner for an opposed-piston engine assembly comprising:

a liner wall that extends longitudinally between a first end and second end and annularly about a piston bore;

said liner wall having an inner face adjacent said piston bore and an outer face that is oppositely arranged with respect to said inner face;

a plurality of inlet ports longitudinally spaced from said first end of said liner wall, each inlet port of said plurality of inlet ports extending across a limited circumferential extent of said liner wall and radially through said liner wall from said outer face to said inner face;

a plurality of exhaust ports longitudinally spaced from said second end of said liner wall, each exhaust port of said plurality of exhaust ports extending across a limited circumferential extent of said liner wall and radially through said liner wall from said outer face to said inner face;

said liner wall having a first end portion that extends longitudinally between said first end of said liner wall and said plurality of inlet ports, a second end portion that extends longitudinally between said second end of said liner wall and said plurality of exhaust ports, and a medial portion that extends between said plurality of inlet ports and said plurality of exhaust ports;

a first plurality of transfer channels that are circumferentially spaced between adjacent inlet ports in said plurality of inlet ports, said first plurality of transfer channels extending in a non-linear path between said first end portion and said medial portion of said liner wall to communicate fluid around said plurality of inlet ports; and a second plurality of transfer channels that are circumferentially spaced between adjacent exhaust ports in said plurality of exhaust ports, said second plurality of transfer channels extending in a non-linear path between said second end portion and said medial portion of said liner wall to communicate fluid around said plurality of exhaust ports.

29. The cylinder liner as set forth in claim 28, further comprising:

a plurality of grooves in said outer face of said liner wall that are parallel to each other, extend inwardly into said liner wall, and are disposed along at least part of said first end portion, said second end portion, and said medial portion of said liner wall.

30. The cylinder liner as set forth in claim 29, further comprising:

a plurality of fins extending along said liner wall at locations disposed within at least some of said grooves in said plurality of grooves to increase surface area and improve heat transfer from said liner wall to fluid disposed in said plurality of grooves.

31. The cylinder liner as set forth in claim 30, wherein said fins are arranged only in grooves that are circumferentially aligned with at least one of said inlet ports and said exhaust ports.

32. The cylinder liner as set forth in claim 29, wherein each of said first and second end portions of said liner wall includes an outboard annular channel in said outer face that is disposed between said plurality of grooves in said first and second end portions and said plurality of inlet and exhaust ports, respectively, and wherein said medial portion of said liner wall includes a first inboard annular channel disposed between said grooves in said medial portion and said plurality of inlet ports, and a second inboard annular channel disposed between said grooves in said medial portion and said plurality of exhaust ports.

33. A method of cooling a cylinder liner disposed in an engine block of an internal combustion engine comprising the steps of:

passing oil through an oil gallery disposed between the engine block and the cylinder liner;

increasing heat transfer between the cylinder liner and the oil passing through the oil gallery by providing the cylinder liner with an oil gallery surface that is disposed in contact with the oil;

manufacturing the oil gallery surface to have a plurality of grooves and a plurality of fins disposed within the plurality of grooves, the plurality of grooves extending inwardly into the cylinder liner and being separated by bridging portions, each of the grooves having a groove width, each of the bridging portions having a bridging portion width, and each of the fins in the plurality of fins having a maximum fin width; and selecting the maximum fin width to be less than the groove width and the bridging portion width, wherein the groove width equals a distance measured across each groove from a bridging portion on one side of the groove to another bridging portion on an opposite side of the groove, wherein the bridging portion width and the maximum fin width both run parallel to the groove width.

* * * * *